US006223700B1

(12) United States Patent
Sano et al.

(10) Patent No.: US 6,223,700 B1
(45) Date of Patent: May 1, 2001

(54) COOLING CONTROL SYSTEM AND COOLING CONTROL METHOD FOR ENGINE

(75) Inventors: Mitsuhiro Sano; Hiroshi Morozumi, both of Kiyose (JP)

(73) Assignee: Nippon Thermostat Co., Ltd., Kiyose (JP)

( * ) Notice: Subject to any disclaimer, the term of this patent is extended or adjusted under 35 U.S.C. 154(b) by 0 days.

(21) Appl. No.: 09/104,006

(22) Filed: Jun. 24, 1998

(30) Foreign Application Priority Data

Jul. 2, 1997 (JP) ..... 9-191912
Apr. 1, 1998 (JP) ..... 10-105801

(51) Int. Cl.[7] ..... F01P 7/16
(52) U.S. Cl. ..... 123/41.1; 123/41.02
(58) Field of Search ..... 123/41.1, 41.02

(56) References Cited

U.S. PATENT DOCUMENTS 4,616,599 * 10/1986 Taguchi et al. ..... 123/41.1
4,726,325 * 2/1988 Itakura ..... 123/41.1
4,930,455 * 6/1990 Creed et al. ..... 123/41.1
5,507,251 * 4/1996 Hollis ..... 123/41.1
5,582,138 * 12/1996 Ziolek et al. ..... 123/41.1
5,738,048 * 4/1998 Suzuki et al. ..... 123/41.1
5,758,607 * 6/1998 Brendel et al. ..... 123/41.1

* cited by examiner

*Primary Examiner*—Noah P. Kamen
*Assistant Examiner*—Jason Benton
(74) *Attorney, Agent, or Firm*—Oblon, Spivak, McClelland, Maier & Neustadt, P.C.

(57) ABSTRACT

A system is provided wherein temperature conduction upon the changing of temperature of cooling water in an engine is forecast, and achievement of a cooling control system with an improved life and reliability and a reduction in cost results therefrom. A butterfly valve for regulating the flow of cooling water is rotatably controlled through a DC motor, a clutch mechanism 33 and a deceleration mechanism 33 so as to cool the engine at an appropriate temperature. A PWM signal generated by a quick response control and a PI control on the basis of at least load information of the engine is supplied to the DC motor 31 from ECU, whereby the butterfly valve 34*b* is rotatably controlled. A butterfly valve adjusting the flow of cooling water is controlled with the degree of valve opening by a thermo-element enclosing a thermal expansive body such as wax. A PTC heater is placed in proximity with the thermo-element, and supplied with current for heating on the basis of operation parameters of an engine to control the cooling efficiency of the cooling water. As a consequence, the characteristics of the butterfly valve which is capable of extremely decreasing rotation torque for adjusting the flow of the cooling water is used, so that mechanical stress can be reduced, resulting in improved life and reliability.

10 Claims, 21 Drawing Sheets

FIG.11

| N(r.p.m) / θT (DEGREE) | 500 | 1000 | | 6000 |
|---|---|---|---|---|
| 10 | $T_{S11}$ | $T_{S12}$ | | $T_{S1n}$ |
| 20 | $T_{S21}$ | $T_{S22}$ | | $T_{S2n}$ |
| | | | (Ts) | |
| 70 | $T_{S(n-1)1}$ | $T_{S(n-1)2}$ | | $T_{S(n-1)n}$ |
| 80 | $T_{Sn1}$ | $T_{Sn2}$ | | $T_{Snn}$ |

FIG.12

| N(r.p.m) / θT (DEGREE) | 500 | 1000 | | 6000 |
|---|---|---|---|---|
| 10 | $\theta_{SO\cdot 11}$ | $\theta_{SO\cdot 12}$ | | $\theta_{SO\cdot 1n}$ |
| 20 | $\theta_{SO\cdot 21}$ | $\theta_{SO\cdot 22}$ | | $\theta_{SO\cdot 2n}$ |
| | | | ($\theta_{SO}$) | |
| 80 | $\theta_{SO\cdot n1}$ | $\theta_{SO\cdot n2}$ | | $\theta_{SO\cdot nn}$ |

FIG.13

+ DEVIATION ← → − DEVIATION

| TEMPERATURE DEVIATION VELOCITY T=ΔT/Δt (°C/S) / TEMPERATURE DEVIATION ΔT (DEGREE) | $T_1$ | $T_2$ | $T_3$ | $T_4$ | $T_5$ | $T_6$ | $T_7$ |
|---|---|---|---|---|---|---|---|
| $\Delta T_1$ | $\theta_{NL}$ | - - - | - - - | $\theta_{NL}$ | - - - | - - - | $\theta_Z$ |
| $\Delta T_2$ | - - - | $\theta_{NM}$ | ($\theta_S$) | - - - | - - - | $\theta_Z$ | - - - |
| $\Delta T_3$ | - - - | - - - | $\theta_{NS}$ | - - - | $\theta_Z$ | - - - | - - - |
| $\Delta T_4$ | $\theta_{NL}$ | - - - | - - - | $\theta_Z$ | - - - | - - - | $\theta_{PL}$ |
| $\Delta T_5$ | - - - | - - - | $\theta_Z$ | - - - | $\theta_{PS}$ | - - - | - - - |
| $\Delta T_6$ | - - - | $\theta_Z$ | - - - | - - - | - - - | $\theta_{PM}$ | - - - |
| $\Delta T_7$ | $\theta_Z$ | - - - | - - - | $\theta_{PL}$ | - - - | - - - | $\theta_{PL}$ |

−DEVIATION ← → +DEVIATION

FIG.14

| TEMPERATURE DEVIATION ΔT (°C) | 0 | 2 | | 5 |
|---|---|---|---|---|
| $\theta_{SP}$ (DEGREE) | $\theta_{SP1}$ | $\theta_{SP2}$ | | $\theta_{SP5}$ |

FIG.15

| TEMPERATURE DEVIATION ΔT (°C) | 0 | 2 | | 5 |
|---|---|---|---|---|
| $\theta_{SI}$ (DEGREE) | $\theta_{SI1}$ | $\theta_{SI2}$ | | $\theta_{SI5}$ |

FIG.16

| N(r.p.m) / $\theta_T$(DEGREE) | 500 | 1000 | | 6000 |
|---|---|---|---|---|
| 10 | $\theta_{S'11}$ | $\theta_{S'12}$ | | $\theta_{S'1n}$ |
| 20 | $\theta_{S'21}$ | $\theta_{S'22}$ | | $\theta_{S'2n}$ |
| | | | ($\theta_{S'}$) | |
| 80 | $\theta_{S'n1}$ | $\theta_{S'n2}$ | | $\theta_{S'nn}$ |

FIG.17

| TEMPERATURE DEVIATION $\Delta T$(℃) | 0 | 5 | 10 | | 15 |
|---|---|---|---|---|---|
| $\theta_{VP}$(%) | $\theta_{VP1}$ | $\theta_{VP2}$ | $\theta_{VP3}$ | | $\theta_{VPn}$ |

FIG.18

| TEMPERATURE DEVIATION $\Delta T$(℃) | 0 | 5 | 10 | | 15 |
|---|---|---|---|---|---|
| $\theta_{VI}$(%/s) | $\theta_{VI1}$ | $\theta_{VI2}$ | $\theta_{VI3}$ | | $\theta_{VIn}$ |

COOLING CONTROL SYSTEM AND COOLING CONTROL METHOD FOR ENGINE

BACKGROUND OF THE INVENTION

1. Field of the Invention

This invention relates to a cooling control system and a cooling control method for cooling an engine of, for example, a vehicle, more particularly, to a cooling control system and method capable of enhancing the responsibility of a temperature control with respect to cooling medium circulated in the engine and improving the control precision.

2. Description of the Related Art

In an engine used in a vehicle or the like, a water cooling type cooling device using a radiator is generally used for cooling the engine.

In this type of the cooling device, a thermostat is used in order to control temperature of the cooling water. When the temperature of the cooling water is lower than a predetermined temperature, the cooling water is circulated in a bypass passage so as not to flow into the radiator with the action of the thermostat.

FIG. 29 shows the above structure, in which numeral 1 is an engine composed of a cylinder block 1*a* and a cylinder head 1*b*, and a fluid conduit illustrated with arrow c is formed in the cylinder block 1*a* and the cylinder head 1*b* of the engine 1.

Numeral 2 is a heat exchanger, namely a radiator. A fluid conduit 2*c* is formed in the radiator 2 as well-known, and a cooling-water inlet portion 2*a* and a cooling-water outlet portion 2*b* of the radiator 2 are connected to a cooling-water conduit 3 circulating the cooling water between the engine 1 and the radiator 2.

The cooling-water conduit 3 is composed of an outflow-side cooling-water conduit 3*a* linking from an outflow portion id of the cooling water, placed in the upper portion of the engine, to the inflow portion 2*a* of the cooling water placed in the upper portion of the radiator 2; an inflow-side cooling-water conduit 3*b* linking from the outflow portion 2*b* of the cooling water, placed in the lower portion of the radiator 2, to an inflow portion 1*e* of the cooling water placed in the lower portion of the engine 1; and a bypass conduit 3*c* connecting the conduits 3*a* and 3*b* to each other.

In a branch portion between the outflow-side cooling-water conduit 3*a* and the bypass conduit 3*c* in the cooling-water conduit 3, a thermostat 4 is disposed. The thermostat 4 is provided therein with a thermal expansive body (e.g. wax) expanding and shrinking with changing of temperature of the cooling water. When the cooling-water temperature is high (e.g. over 80° C.), the valve is opened by the expansion of the thermal expansive body so that the cooling water flowing from the outflow portion 1*d* of the engine 1 flows through the outflow-side cooling-water conduit 3*a* into the radiator 2. The cooling water cooled in the radiator 2 and dissipating heat is operated to flow from the outflow portion 2*b* through the inflow-side cooling-water conduit 3*b*, and through the inflow portion 1*e* of the engine 1 into the engine 1.

When the temperature of the cooling water is low, the valve of the thermostat 4 is closed by the shrinkage of the thermal expansive body, so that the cooling water flowing from the outflow portion 1*d* of the engine 1 flows through the bypass conduit 3*c*, and through the inflow portion 1*e* of the engine into cooling pipes c of the engine 1.

In FIG. 29, numeral 5 is a water pump disposed in the inflow portion 1*e* of the engine 1, of which the rotating shaft is rotated by the rotation of a crank-shaft (not shown) of the engine 1, so that the cooling water is forcibly circulated. Numeral 6 is a fan unit for forcibly blowing cooled air into the radiator 2, and composed of a cooling fan 6*a* and a fan motor 6*b* rotationally driving the cooling fan 6*a*.

The valve opening and the valve closing actions by the thermostat are determined by the temperature of the cooling water, and also by the expansion and shrinkage of the thermal expansive body such as wax, therefore the temperature in the valve opening and the temperature in the valve closing are not constant. The thermal expansive body such as wax takes some time to operate the valve after receiving the changing of the temperature of the cooling water until. Especially, the responsibility during the decrease of the temperature is inferior as compared with that during the increase of the temperature, that is to say it has hysteresis properties. As a result, there is a technical disadvantage in which the cooling water is not easily adjusted to be in a constant temperature required.

It is proposed that the flow of the cooling water is electrically controlled not to harness the actions of opening and closing valve by the thermal expansive body such as wax.

This is, for example, the control of a rotational angle of a butterfly valve using a stepping motor. Omitting the thermostat 4 shown in FIG. 29, a valve unit 7 provided with the butterfly valve instead of the thermostat 4 is disposed in the outflow-side cooling-water conduit 3*a* as illustrated with a long dashed line in FIG. 29.

FIG. 30 shows an example of the above valve unit 7, in which a circular plane shaped butterfly valve 7*a* is supported in the cooling-water conduit 3*a* to be rotated by a shaft 7*b*. A worm wheel 7*c* is attached on an end of the shaft 7*b*, and a worm 7*e* inserted in a rotational drive shaft of a motor 7*d* is engaged with the worm wheel 7*c*.

The motor 7 is supplied with the operation current for rotating the drive shaft thereof in the forward and reverse directions by a control unit (ECU) controlling the operation condition of the overall engine. Therefore, when the current for rotating the drive shaft in the forward direction is passed into the motor 7*d* by the action of the ECU, the shaft 7*b* of the butterfly valve 7*a* is rotated in one direction by a well-known decelerating action produced by the worm 7*e* and the worm wheel 7*c*, whereby the plane direction of the butterfly valve 7*a* is rotated in the same direction as the flowing direction of the cooling-water conduit 3*a*, resulting in the valve opening state.

On the other hand, when the current for rotating the drive shaft in the reverse direction is passed into the motor 7*d* by the action of ECU, the shaft 7*b* of the butterfly valve 7*a* is rotated in the other direction, whereby the plane direction of the butterfly valve 7*a* is rotated in a direction perpendicular to the flowing direction of the cooling-water conduit 3*a*, resulting in the valve closing state.

The ECU receives information such as the temperature of the cooling water in the engine, and controls the temperature of the cooling water by controlling the aforementioned motor with the use of the above information.

In addition, in response to a control signal from the control unit (ECU) fetching various operational parameters which are detected from the engine, a stepping motor (not shown) rotating the butterfly valve is driven so as to control the flow of the cooling water flowing toward the radiator.

In the cooling control system using the butterfly valve as described thus far, a temperature detecting element such as a thermistor (not shown) is disposed in a part of the pipes for the cooling water in the engine 1, and the motor 7*d* is driven responsive to the temperature of the cooling water detected by the temperature detecting element.

According to the structure as described above, the effects of the hysteresis properties seen in the former example using the thermostat including the thermal expansive body is decreased somewhat.

After the temperature detecting element senses the changing of the temperature of the cooling water, however, the ECU controls an angle of the valve on the basis of the sensed changing, that is to say it is a follow-up control. In consequence, in this point both examples are the same.

Even the cooling control system using the butterfly valve in the latter example cannot escape having a hunting phenomenon which is the temperature of the cooling water is changed around a specific temperature Tc at all times, resulting in the difficulty of the control with stability and high precision.

Generally, when an engine for a vehicle is driven in a high temperature state before overheating, fuel economy is enhanced and the generation of a poisonous gas is reduced.

When the aforementioned hunting occurs, in order to avoid the worst state of the overheating of the engine, the aforementioned temperature Tc of the cooling water should be adjusted to be lower, thereby creating a technical disadvantage of sacrificing fuel economy.

Where an actuator to rotate the aforementioned butterfly valve is concerned, for example, the stepping motor is provided therein as described hereinbefore, and driven by the pulse control signal caused by ECU, thereby rotating the butterfly valve.

The maximum rotational speed (rpm/min) of the aforementioned type of the stepping motor is extremely lower on the action thereof than that of a direct-current motor as is well-known. Therefore, when it is structured to obtain predetermined rotation torque using the aforementioned worm gear or another decelerating gear, and to afford the appropriate rotational speed to the butterfly valve, the motor itself is inevitably required to have high torque, resulting in a technical disadvantage in that the overall actuator is larger in size.

Moreover, for example, upon any failure occurring in the motor or damage of the aforementioned decelerating gear, the operation of opening and closing the butterfly valve results in an impossibility. For example, when the above failure or damage occurs in a state that the butterfly valve is closed or is nearly closed at a half open angle, the engine is cooled insufficiently, thereby having a technical disadvantage in that the engine is overheated without being noticed by a driver.

The present invention is performed in order to resolve the technical disadvantages described thus far. It is an object of the present invention to provide a cooling control system and a cooling control method having the improved control precision in which temperature is conducted in a state that the changing of temperatures of the cooling water is forecast, and the aforementioned hunting does not occur.

It is another object of the present invention to provide a cooling control system capable of exploiting a fail-safe function and previously avoiding disadvantages such as the overheat of an engine, controlled by damaging a part of a drive device of a flow control valve or the like.

In the structure in which the valve unit 7 is controlled by the stepping motor after receiving the control signal from the ECU as described above, there may be cases where an opening sensor for detecting the degree of valve opening (not shown) as well as the stepping motor rotationally driving the butterfly valve is needed. This needs adoption of a complicated control system, for example, the stepping motor is driven by returning the information of the opening sensor to the ECU, resulting in high costs.

The present invention is carried out in order to resolve the aforementioned technical disadvantage, and is characterized in that the degree of butterfly-valve opening is controlled with a thermo-element enclosing a thermal expansive body such as wax, and the thermal-element is forcibly operated by a heater to respond thermally. Therefore, it is an object of the present invention to provide a cooling control system capable of improving the responsibility of a temperature control for cooling water and the control precision at small cost.

SUMMARY OF THE INVENTION

A cooling control system for an engine according to the present invention carried out for resolving the aforementioned disadvantages, in which a circulating passage of a cooling medium is formed between a fluid conduit formed in the engine and a fluid conduit formed in a heat exchanger, and heat generated in the engine is dissipated with the heat exchanger by circulating the cooling medium in the circulating passage, includes: a flow control means for controlling the flow of the cooling medium in the circulating passage between the engine and the heat exchanger in accordance to the degree of valve opening; an information extracting means for extracting at least load information in respect of the engine and temperature information of the cooling medium; and a control unit finding a target setting temperature of the cooling medium on the basis of the load information, and finding a temperature deviation of the temperature information of the cooling medium from the target setting temperature, and generating a control signal for an actuator of the flow control means on basis of the relationship between the temperature deviation and a changing velocity of the temperature deviation.

In this case, the load information is generated from at least engine speed and information of the degree of throttle-valve opening.

It is structured that the control unit operates a first control signal generating mode for generating a control signal for the actuator when the temperature deviation and the changing velocity of the temperature deviation are below predetermined values, and a second control signal generation mode for generating a control signal for the actuator when the temperature deviation and the changing velocity of the temperature deviation exceed predetermined values.

In this point, it is preferably structured that the first control signal generating mode includes an integral control element continuously and slightly changing the flow of the cooling medium, controlled by the flow control means, at unit-times in response to the temperature deviations; and the second control signal generating mode generates the control signal for the actuator on the basis of flow setting data of the cooling medium which is read out from a map written to correspond with the temperature deviation and the changing velocity of the temperature deviation.

In a further preferred embodiment, a sensor showing the flow of the cooling medium controlled by the flow control means is included, in which information obtained from the sensor is used for a computing process in the control unit.

In the preferred embodiment, the flow control means comprises a butterfly valve which is disposed in a tubular cooling-medium conduit and of which an angle in the plane direction is changed with respect to a flowing direction of the cooling medium; and the sensor showing the flow of the cooling medium is an angle sensor generating information in respect of a rotational angle of the butterfly valve.

In the preferred embodiment, it is structured that the actuator includes a direct-current motor driven to be rotated on the basis of the control signal outputted from the control unit, a clutch mechanism transferring and releasing a rotational driving force of the direct-current motor, and a deceleration mechanism decelerating rotational speed of the direct-current motor through the clutch mechanism, and the flow control means is provided with a return spring propelling the flow control means in the direction of valve opening.

The clutch mechanism receives an abnormal condition output and turns a released state so that the flow control means holds a valve opening state with the return spring.

A cooling control method for an engine according to the present invention carried out in order to resolve the aforementioned disadvantages, in which a circulating passage of a cooling medium is formed between a fluid conduit formed in the engine and a fluid conduit formed in a heat exchanger and heat generated in the engine is dissipated with the heat exchanger by circulating the cooling medium via a flow control means in the circulating passage, is characterized by including: a step of fetching at least load information in respect of the engine and temperature information of the cooling medium; a step of finding a target setting temperature of the cooling medium on the basis of the load information; a step of finding a temperature deviation of the temperature information of the cooling medium from the target setting temperature; a step of computing the temperature deviation and a changing velocity of the temperature deviation; a step of generating a control signal for an actuator of the flow control means on basis of the relationship between the temperature deviation and the changing velocity of the temperature deviation; and a step of driving the actuator on the basis of the control signal and operating the flow control for the cooling medium flowing into the heat exchanger.

In this case, preferably, a step of determining whether or not the temperature deviation and the changing velocity of the temperature deviation are below predetermined values is further added in the step for generating the control signal to drive the actuator, and when the values of the temperature deviation and the changing velocity of the temperature deviation are determined to be below the predetermined values, a step of generating the control signal including an integral control element continuously and slightly changing the flow of the cooling medium, controlled by the flow control means, at unit-times in response to the temperature deviations is performed, and when the values of the temperature deviation and the changing velocity of the temperature deviation are determined not to be below the predetermined values, a step of generating the control signal on the basis of flow setting data of the cooling medium which is read out from a map written to correspond with the temperature deviation and the changing velocity of the temperature deviation is performed.

According to the structure and the control method described thus far, the target setting temperature of the cooling water as the cooling medium is defined on the basis of, for example, the load information obtained from the engine speed and the angle information of the throttle valve. The temperature deviation is found at a predetermined unit of time from the target setting temperature and the temperature information of the cooling water, and also the changing velocity of the temperature deviation is found.

The control signal is generated with the temperature deviation and the changing velocity of the temperature deviation as parameter, and sent to the actuator driving, for example, the butterfly valve as the flow control means.

In this case, the generating mode for the control signal is changed in accordance with values of the temperature deviation and the changing velocity of the temperature deviation, and when the values of the temperature deviation and the changing velocity of the temperature deviation are less than predetermined values, the rotational angle of the butterfly valve is controlled by a PI control including the integral control element that changes the flow of the cooling water at unit-times continuously and slightly.

When the values of the temperature deviation and the changing velocity of the temperature deviation exceeds the predetermined values, a quick response control for driving the butterfly valve quickly is performed on the basis of the flow setting data of the cooling medium which is read out from a map written to correspond with the temperature deviation and the changing velocity of the temperature deviation.

As a result, the temperature is conducted in the state in which the changing of the temperatures of the cooling water is forecast, and with using in conjunction with the aforementioned PI control, the control decision capable of avoiding the occurrence of hunting of the cooling water is obtained.

In addition, the actuator for rotationally driving the butterfly valve has the DC motor, the clutch mechanism and the deceleration mechanism and drives the butterfly valve on the basis of the aforementioned control signal.

In this case, the high-speed properties of a direct-motor is fully used by using the DC motor, and the butterfly valve is driven with a sufficient rotational torque by combining the small sized DC motor and the deceleration mechanism. Therefore, the overall actuator can be smaller in size.

The return spring propelling the butterfly valve toward the opening state is included and the actuator has the clutch mechanism, whereby the opening operation of the valve by the return spring in an abnormal state is smoothly performed.

Moreover, the formation in which the clutch mechanism is placed between the DC motor and the deceleration mechanism allows the driving force, namely torque, applied to the clutch mechanism to be decreased considerably. The sliding and the wear and tear of the clutch mechanism can be avoided, resulting in miniaturization of the clutch mechanism as well as the actuator.

In addition, a cooling control system for an engine according to the present invention, in which a circulating passage of a cooling medium is formed between a fluid conduit formed in the engine and a fluid conduit formed in a heat exchanger, and heat generated in the engine is dissipated with the heat exchanger by circulating the cooling medium in the circulating passage, includes: a butterfly valve controlling the flow of the cooling medium in the circulating passage between the engine and the heat exchanger in accordance to the degree of valve opening; a thermo-element for controlling the degree of butterfly-valve opening responsive to the changing of temperature, and provided with a heater for heating; and a control unit generating a control signal for controlling electric energy for heating, which is supplied to the heater provided in the thermo-element, on the basis of at least the temperature information of the cooling medium.

In this case, it is advisable that the cooling control system for the engine according to claim 1, in which the control unit also generates a control signal for controlling driving of a fan motor that is for forcibly cooling the heat exchanger. The control unit is added with the engine speed and the load information regarding the engine, and performs a control of the electric energy for heating, supplied to the heater provided to the thermo-element, and/or a drive control for the fan motor.

In the preferred embodiment, the control signal for the electric energy for heating, supplied to the heater provided in the thermo-element, and the drive control signal for the fan motor are formed with a PWM signal, and a duty value of the PWM signal is changed to control the supplied electric energy.

The thermo-element is disposed to be in thermal-contact with the cooling medium, and the degree of butterfly-valve opening is controlled responsive to the temperature of the cooling medium and the heating of the heater heating in accordance to electric power supplied by the control unit. Alternatively, the thermo-element is disposed to be thermally insulated from the cooling medium, and the degree of butterfly-valve opening is controlled responsive to the heating of the heater heating in accordance to electric power supplied by the control unit.

Preferably, the thermo-element is provided with a wax element enclosing wax responsive to the temperature of the cooling medium and/or the heating of the heater, a piston member projected by the wax-element with the expanding action of the wax in the wax-element, and a cam member carrying out rotational movement with respect to a shaft with the projecting of the piston member, and the degree of butterfly-valve opening is changed with the rotational movement of the cam member.

According to the cooling control system as structured thus far, the flow of the cooling water in the circulating passage between the engine and the heat exchanger is adjusted by means of the degree of butterfly-valve opening so that the cooling water is controlled to be adjusted to be at an appropriate temperature. The opening state of the butterfly valve is adjusted by the thermo-element provided with the heater for heating, so that the degree of butterfly-valve opening can be controlled by adjusting electric energy supplied to the heater in response to the operation state of the engine.

Moreover, as is well-known, the butterfly valve is rotated around the shaft, thereby the flow can be adjusted and the opening and closing operation is carried out insensitive to the pressure of the cooing water. Therefore, the cooling control system has characteristics that the rotation torque required for the adjustment of the flow of the cooling water is extremely small.

As a result, as compared with a conventional cooling control system in which the opening and closing of a poppet valve is controlled with wax as a thermal expansive body, the opening and closing of the valve can be controlled with small driving force in the cooling control system according to the present invention, so that elements of mechanical stress can be reduced, resulting in the improvement of the life and reliability and the reduction in size.

It is should be mentioned that, comparing with a conventional cooling control system in which the degree of butterfly-valve opening is controlled by a stepping motor, the structure in the present invention can be simplified, resulting in the reduction in costs of the overall device.

BRIEF DESCRIPTION OF THE DRAWINGS

FIG. 11 is a block diagram showing an example of a data table used in a process routine shown in FIG. 7;

FIG. 12 is a block diagram showing another example of a data table used in a process routine shown in FIG. 7;

FIG. 13 is a block diagram showing an example of a data table used in a process routine shown in FIG. 8;

FIG. 14 is a block diagram showing an example of a data table used in a process routine shown in FIG. 9;

FIG. 15 is a block diagram showing another example of a data table used in a process routine shown in FIG. 9;

FIG. 16 is a block diagram showing an example of a data table used in a process routine shown in FIG. 10;

FIG. 17 is a block diagram showing an example of a data table used in another embodiment of a cooling control system according to the present invention;

FIG. 18 is a block diagram showing another example of a data table used in the above embodiment;

DESCRIPTION OF THE PREFERRED EMBODIMENT(S)

A cooling control system for an engine according to the present invention will be described below with reference of preferred embodiments shown in the attached drawings.

Figure 1:
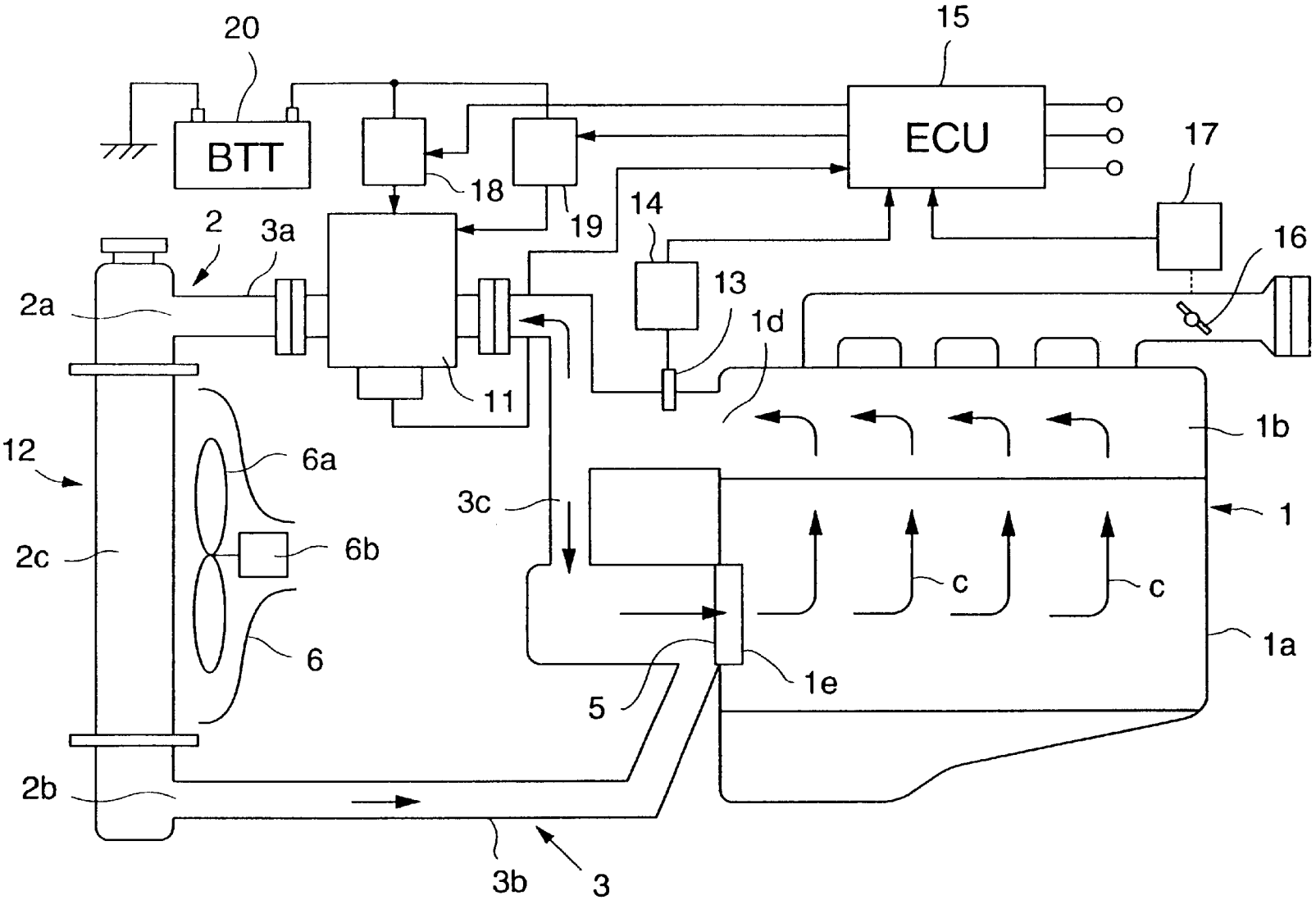
FIG. 1 is a block diagram showing an embodiment when a cooling control system according to the present invention is applied to an engine for a vehicle.
Figure 29:
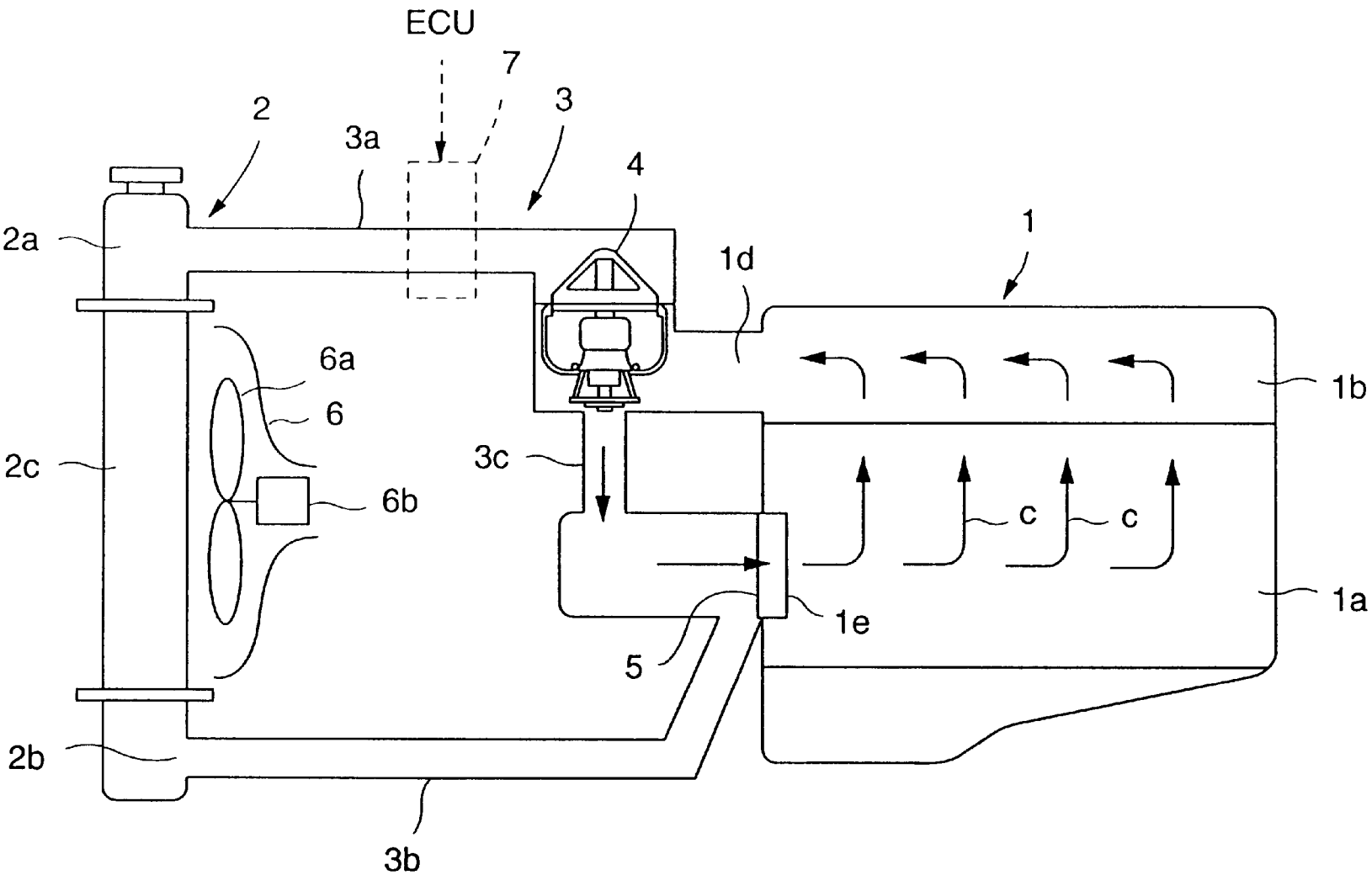
FIG. 29 is a block diagram showing an example of a conventional cooling system for an engine for a vehicle.
Figure 30:
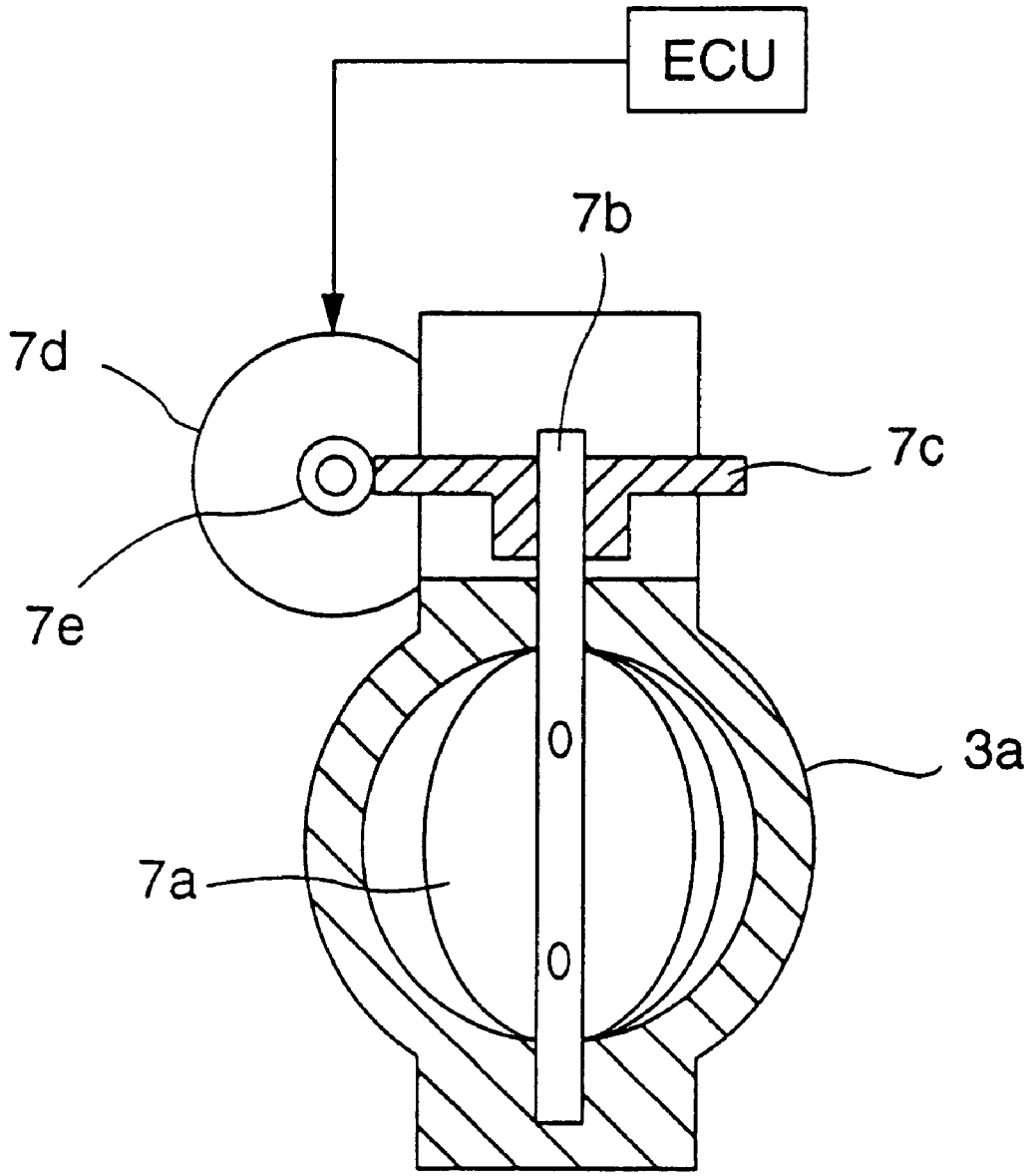
FIG. 30 is a block diagram with a partially cross section of an example of a conventional flow control system with a butterfly valve.

FIG. 1 shows the overall structure of a cooling control system for an engine for a vehicle. In FIG. 1, the same reference numerals will be used to designate the same or similar components as those in the conventional cooling control system shown in FIG. 29, so that the descriptions of the components and operations will be omitted or simplified as necessary.

As shown in FIG. 1, a flow control unit 11 is connected with a flange to the outflow-side cooling-water conduit 3*a* located between the outflow portion 1*d* of the cooling water, placed in the upper portion of the engine, and the inflow portion 2*a* of the cooling water placed in the upper portion of the radiator 2 as the heat exchanger.

As a result, a circulating passage 12 for a cooling medium, namely the cooling water is formed with including the flow control unit 11.

In the outflow portion 1*d* of the cooling water in the engine 1, a temperature detecting element 13 such as a thermistor is disposed. A value detected by the temperature detecting element 13 is converted into data having a readable form of the control unit (ECU) 15 by a transducer 14, and sent to the control unit (ECU) 15 controlling the operation of the overall engine.

In a preferred embodiment shown in FIG. 1, information regarding the degree of opening is also sent to the control unit 15 from a throttle position sensor 17 detecting the degree that a throttle valve 16 of the engine 1 is opened. Incidentally, although not shown in the drawing, the control unit 15 also receives other information such as the engine speed and so on.

On the other hand, the control signals are sent from the control unit 15 to a motor control circuit 18 and a clutch control circuit 19. The motor control circuit 18 and the clutch control circuit 19 control current from the battery 20 to supply the control current to a direct-current motor control circuit and a clutch control circuit which are provided in the flow control unit 11 and described below.

Figure 2:
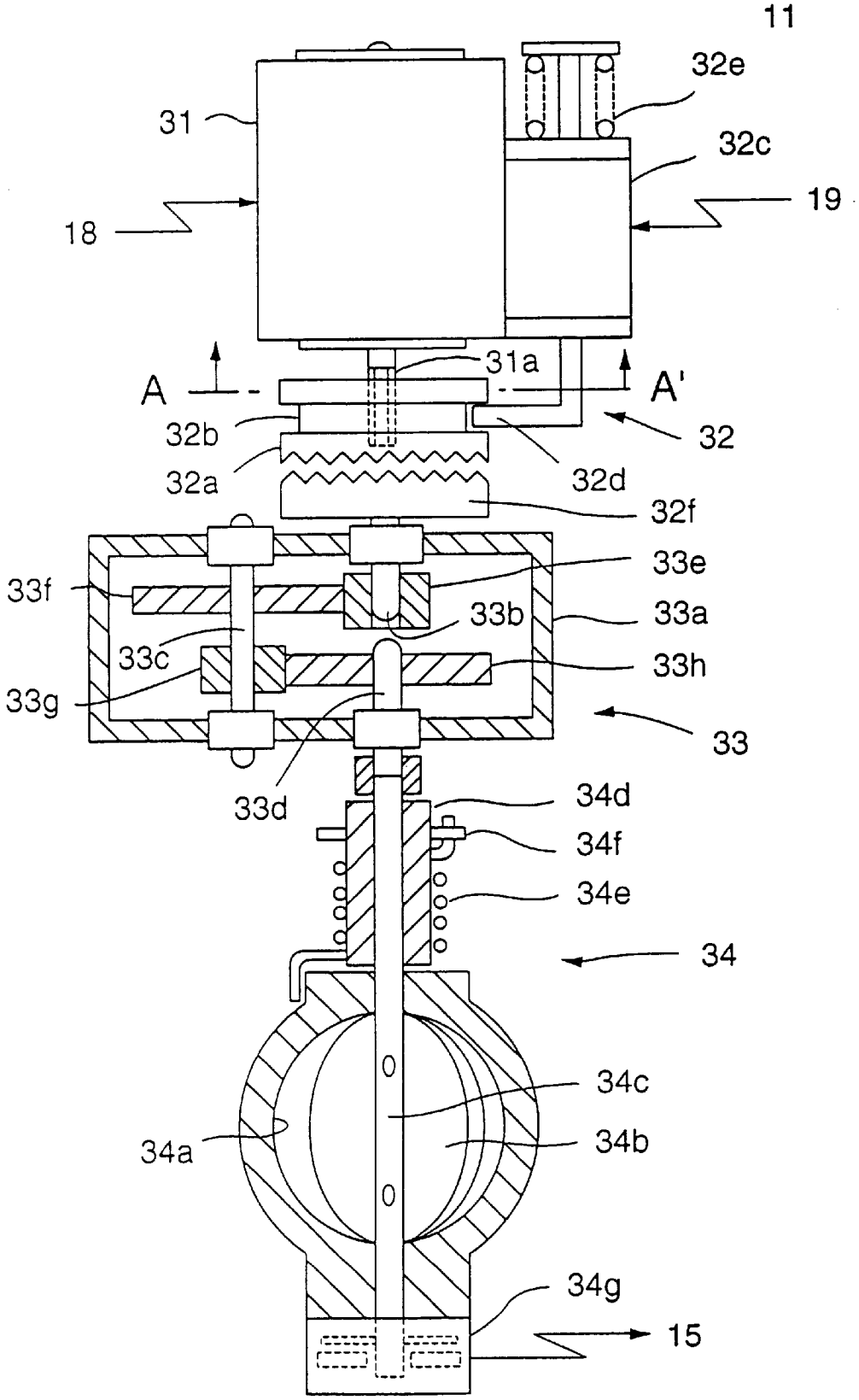
FIG. 2 is a block diagram with a partially cross-section of a flow control unit used in the device in FIG. 1.

FIG. 2 schematically shows the structure of the aforementioned flow control unit 11 with a partially cross section. The flow control unit 11 includes a butterfly valve and an actuator for driving the butterfly valve.

The actuator is provided with a direct-current motor 31, in which a first clutch disc 32*a* constituting a clutch mechanism 32 is connected to a rotating shaft 31*a* of the DC motor 31 in the rotational direction of the rotating shaft 31*a*, and attached to slide in the axial direction.

Figure 3:
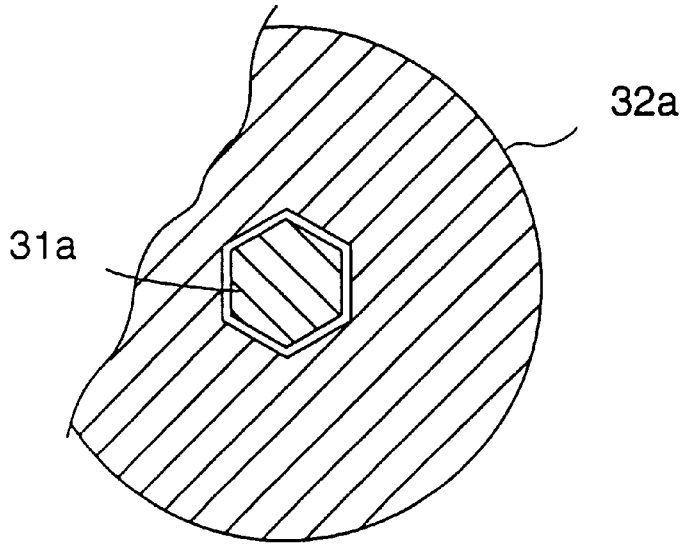
FIG. 3 is an enlarged sectional view taken along the A–A' line in FIG. 2.

FIG. 3 shows a view taken along the A–A' line in FIG. 2. The rotating shaft 31*a* of the motor has a hexagonal contour as shown in the drawing. In the central portion of the first clutch disc 32*a*, a hexagonal hole is formed to surround the rotating shaft 31*a* of the motor.

Therefore, the first clutch disc 32*a* is combined in the rotational direction of the rotating shaft 31*a* and works to slide in the axial direction.

Returning to FIG. 2, a ring-shaped gutter portion 32*b* is formed on the outer circumferential face of the first clutch disc 32*a*. Into the gutter portion 32*b*, an end portion of a working portion 32*d* of an electromagnetic plunger 32*c* is loosely inserted. A coil spring 32*e* is attached to the plunger 32*c*. In the normal state in which the plunger 32*c* is not energized, the first clutch disc 32*a* is retracted toward the motor 31 by the extending action of the coil spring 32*e* as shown in FIG. 2.

A second clutch disc 32*f* is placed opposite the first clutch disc 32*a*, and fixed to an input-side rotating shaft 33*b* constituting a deceleration mechanism 33.

In the deceleration mechanism 33, the input-side rotating shaft 33*b*, a transitional rotating shaft 33*c* and an output-side rotating shaft 33*d* are disposed parallel to each other by bearings located in a case 33*a*.

On the input-side rotating shaft 33*b*, a pinion 33*e* is fixed and meshed with a spur gear 33*f* fixed on the transitional rotating shaft 33*c*. In addition, a pinion 33*g* fixed on the transitional rotating shaft 33*c* is meshed with a spur gear 33*h* fixed on the output-side rotating shaft 33*d*.

The deceleration mechanism 33 has, for example, approximately one/fiftieth of a deceleration ratio due to the above formation.

The output-side rotating shaft 33*d* of the deceleration mechanism 33 is combined with a drive shaft of a flow control valve 34. The flow control valve 34 is provide with a plane-shaped butterfly valve 34*b* located in a tubular cooling medium sluice 34*a*. The butterfly valve 34*b* is structured so that the flow of the cooling water is controlled by the angle of the plane direction, formed by a rotational angle of a shaft 34*c* as the drive shaft, with respect to the flowing direction of the cooling water. More specifically, when an angle of the plane direction of the butterfly valve 34*b* is approximately zero with respect to the flowing direction of the cooling water, the valve is opened. When an angle of the plane direction is approximately perpendicular to the flowing direction of the cooling water, the valve is closed. The flow of the cooling water is linearly controlled in relation to the angle taken between zero and 90 degrees.

In the deceleration mechanism 33 side of the shaft 34*c*, a collar 34*d* is secured to the shaft 34*c*, and a coil shaped return spring 34*e* is wound on the outer circumference face of the collar 34*d*. An end of the return spring 34*e* is engaged with a part of a tubular shaped body constituting the cooling medium sluice 34*a*, and the other end of the return spring 34*e* is engaged with a projected portion 34*f* attached to a part of the collar 34*d*.

In this state, the return spring 34*e* propels the butterfly valve 34*b* combined with the shaft 34*c* to form the valve opening state.

On the other end portion, opposite from the deceleration mechanism 33, of the shaft 34*c*, an angle sensor 34*g* is combined, thereby detecting the rotational angle of the butterfly valve 34*b*.

In the flow control unit 11 as structured thus far, the DC motor 31 receives drive current from the motor control circuit 18 shown in FIG. 1. The electromagnetic plunger 32*c* of the clutch mechanism 32 receives drive current from the clutch control circuit 19 shown in FIG. 1. And the data output regarding the rotational angle of the butterfly valve detected by the angle sensor 34*g* is sent to the control unit 15 shown in FIG. 15.

In the structure of FIG. 2, the electromagnetic plunger 32*c* is energized, whereupon the working portion 32*d* moves the first clutch disc 32*a* toward the second clutch disc 32*f* to make a contact state. Upon the drive current being applied to the DC motor 31, the rotation driving force of the motor 31 is decreased by the deceleration mechanism, and rotates the butterfly valve 34*b* through shaft 34*c*. With the rotation of the shaft 34*c*, the angle sensor 34*g* sends feedback of data regarding the rotational angle to the control unit 15.

Figure 4:
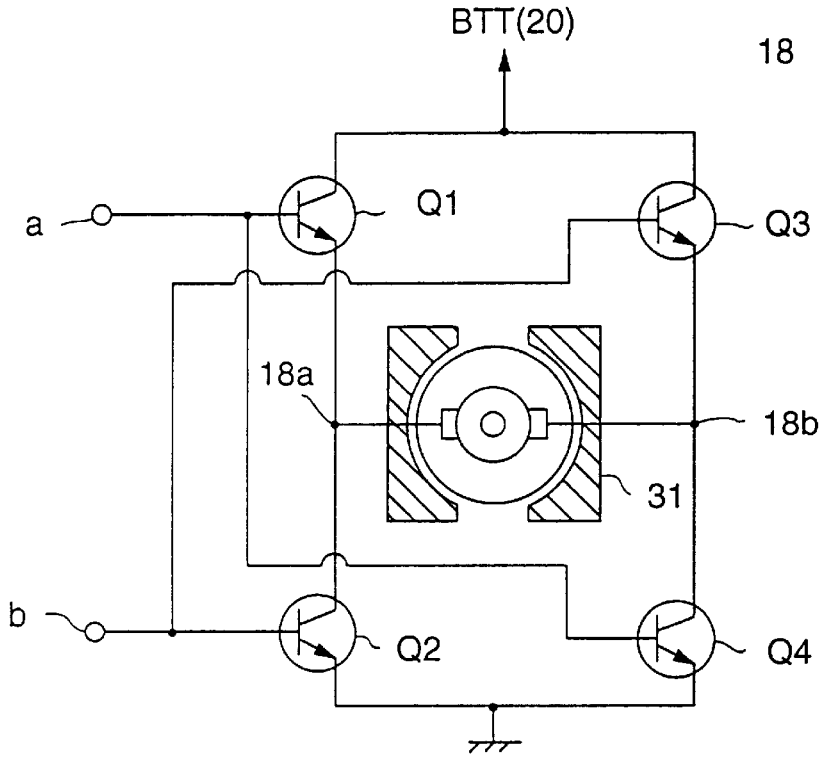
FIG. 4 is a connection diagram showing a motor drive circuit used in the device in FIG. 1.

FIG. 4 is a connection diagram of the motor control circuit 18. In the motor control circuit 18, a bridge circuit is formed by a first switching element Q1 and a second switching element Q2 placed in series between a positive terminal and a negative terminal (earth) of the power (the battery 20), and a third switching element Q3 and a fourth switching element Q4 similarly placed in series between the positive terminal and the negative terminal.

Each switching element is composed of an NPN-type bipolar-transistor. In consequence, each collector of the first transistor Q1 and the third transistor Q3 is connected to the positive terminal of the battery 20. Each emitter of the second transistor Q2 and the fourth transistor Q4 is connected to the earth.

The emitter of the first transistor Q1 and the collector of the second transistor Q3 are connected and form a first junction 18*a*. The emitter of the third transistor Q3 and the collector of the fourth transistor Q4 are connected and form a second junction 18*b*.

Between the first junction 18*a* and the second junction 18*b*, a pair of drive-current input terminals of the motor 31 are respectively connected.

Control pole terminals of the first transistor Q1 and the fourth transistor Q4, namely bases are connected to each other and form an input terminal a. Bases of the second and third transistors Q2 and Q3 are connected to each other and form an input terminal b.

Figure 5:
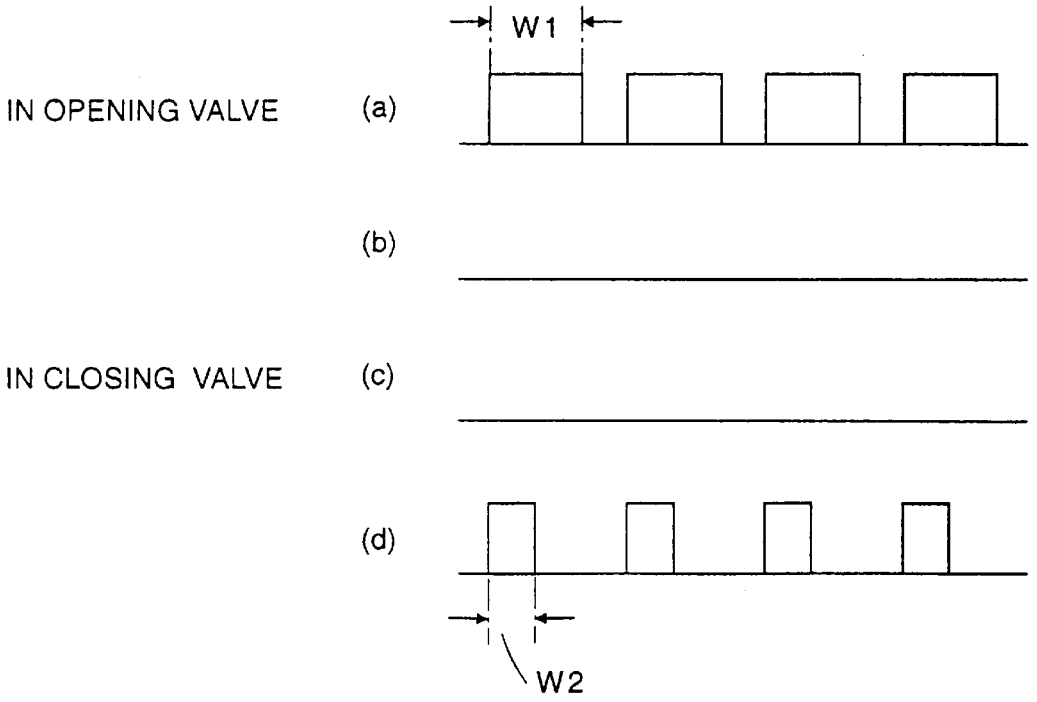
FIG. 5 is a waveform diagram showing an example of a control signal applied to the motor drive circuit shown in FIG. 4.

FIG. 5 shows switch control signals alternatively sent from the control unit 15 to the input terminal a and the input terminal b of FIG. 4.

The control signal is formed with a waveform by PWM, and drives at a fixed time period in response to the rotational direction of the motor. In closing the valve, the control signal having a longer pulse width (W1) is sent only to the input terminal a. In opening the valve, the control signal having a shorter pulse width (W2) is sent only to the input terminal b.

When the butterfly valve 34*b* is to be opened, the return spring 34*e* is efficiently driven with the shorter pulse width using torque in the returning direction thereof.

Where the butterfly valve 34*b* is to be closed, the switch control signal having the pulse width shown as (a) in valve closing in FIG. 5 is sent to the terminal a of FIG. 4. Therefore, the transistors Q1 and Q4 are ON-controlled by the switch control signal corresponding to the pulse width shown as (a) in FIG. 5, and the motor 31 is rotationally driven in a direction.

Where the butterfly valve 34*b* is to be opened, the switch control signal having the pulse width shown as (b) in valve opening in FIG. 5 is sent to the terminal b of FIG. 4. Therefore, the transistors Q2 and Q3 are ON-controlled by the control signal of the pulse width shown as (b) in FIG. 5, and the motor 31 is rotationally driven in the reverse direction.

Figure 6:
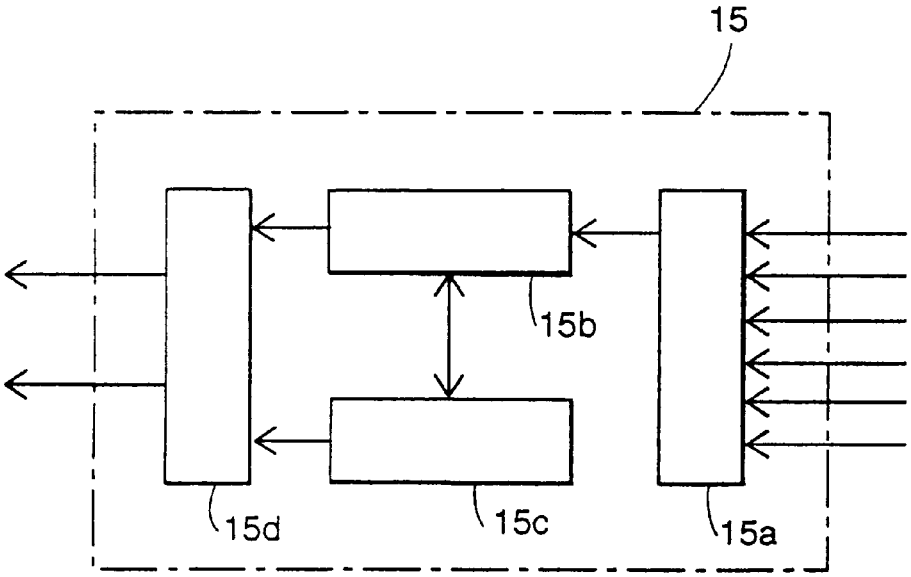
FIG. 6 is a block diagram showing a design of an engine control unit (ECU) shown in FIG. 1.

FIG. 6 shows a basic design of the ECU 15 shown in FIG. 1. The ECU 15 includes a signal processing part 15*a* for converting a signal, sent from each sensor, to a digital signal recognizable by the ECU; a comparison part 15*b* for comparing the input data processed in the signal processing part 15*a* with various data stored in a table form in a memory part 15*c*; and a signal processing part 15*d* for computing the compared result by the comparison part 15*b* and outputting it as the control signal.

The operation of the cooling control system for the vehicle engine shown in FIG. 1 to FIG. 6 will be explained below with reference to control flows mainly performed by the ECU 15 shown in FIG. 7 and the following drawings.

Figure 7:
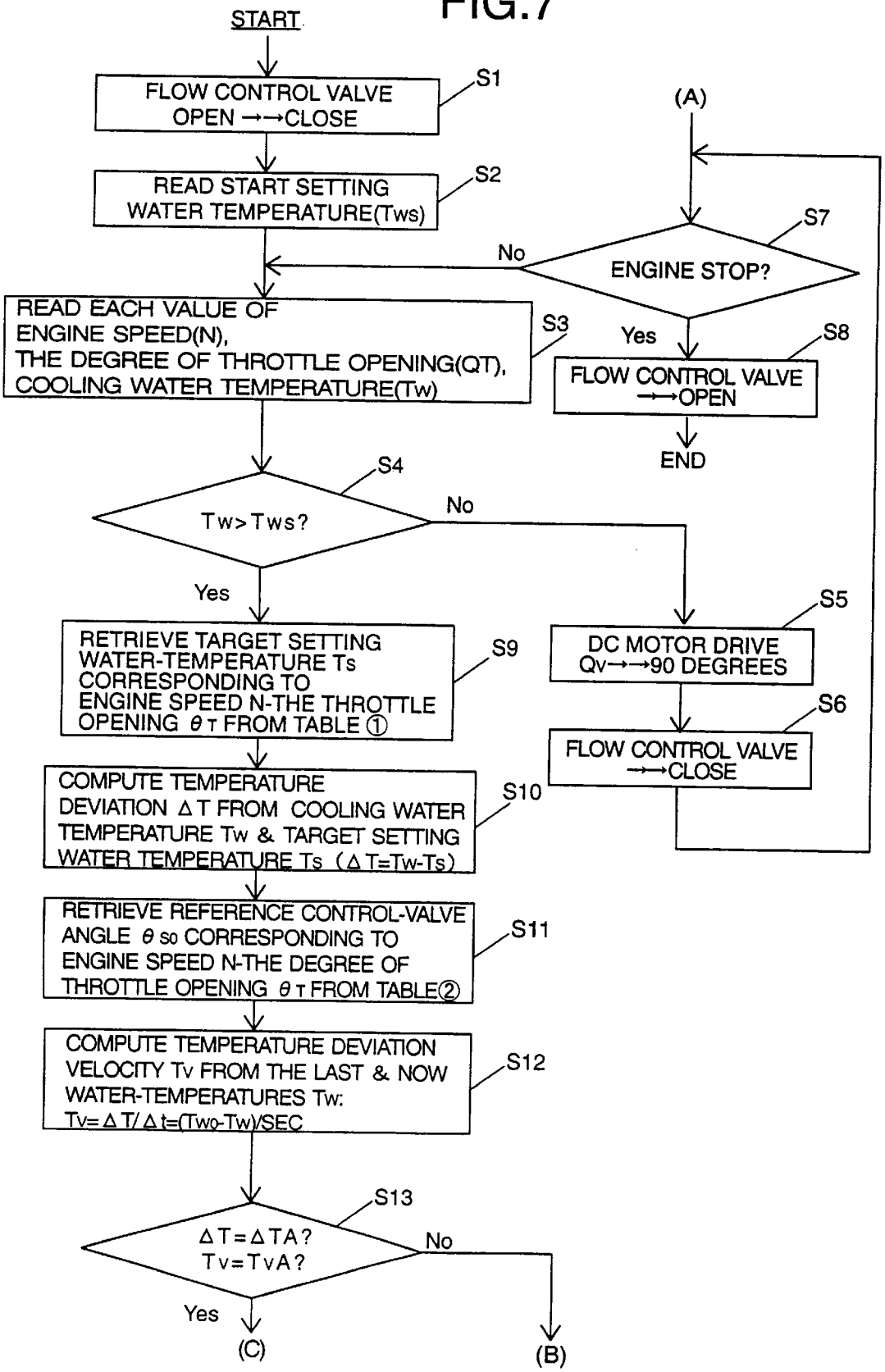
FIG. 7 is a flow chart for explaining the action in ECU.

Referring the flow of FIG. 7, the vehicle engine is started, whereupon the control signal is sent from the ECU 15 to the clutch control circuit 19, whereby the drive current is applied to the electromagnetic plunger 32*c* shown in FIG. 2, and the clutch mechanism 32 is in the transmissive state.

At this time, the ECU 15 sends the control signal for closing a flow control valve, namely the butterfly valve 34*b* in the valve opening state, to the motor control circuit 18 (step S1).

As a result, the control signal having the pulse width (W1) shown as the valve closing state in FIG. 5 is added to the terminal a in the motor control circuit 18 in FIG. 4, whereby the DC motor 31 is rotationally driven, and the butterfly valve 34*b* is temporally closed through the deceleration mechanism 33.

In step S2, the ECU 15 reads an initial engine-starting cooling-water temperature (Tws) from the transducer 14 receiving the information from the temperature detecting element 13. Continuously, in step S3, the ECU 15 fetches the engine speed (N), the degree of throttle opening (θT) and a cooling-water temperature (Tw).

After that, in step S4, the relationship between the cooling-water temperature (Tw) and the cooling-water temperature in engine starting (Tws) is determined. That is to say, when the condition of Tw>Tws is determined to be NO, the flow goes to step S5. Here, the control signal is sent to the motor control circuit 18, and an angle of valve is set so that the detected angle by the angle sensor 34*g* is to be approximately 90 degrees. Thereby, the butterfly valve 34*b* retains the valve closing state (step S6).

In step S7, whether the engine is stopped or not is determined and when the engine (NO) is determined to not be stopped, a routine of returning to step S3 is repeated thereafter. In step S7, when the stopping of the engine (YES) is determined, the flow shifts to step S8. Here, the ECU 15 stops to send the control signal to the clutch control circuit 19, and the operation of the electromagnetic plunger 32*c* is stopped.

As a result, the clutch mechanism 33 is released and the butterfly valve 34*b* is to be in a valve opening state due to the action of the return spring 34*e*.

Returning to step S4, the condition of Tw>Tws is determined to be YES, whereupon the flow goes to step S9. Here, a target setting water-temperature (Ts) corresponding to the engine speed (N)—the degree of throttle opening (θT) as the load information of the engine is retrieved from a table ① shown in FIG. 11.

On the table ① shown in FIG. 11, the target setting water-temperature (Ts) is written in matrix between the engine speed (N) and the degree of throttle opening (θT). Incidentally, for convenience in writing in the drawing, the relationship between the engine speed (N) and the degree of throttle opening (θT) is roughly written greatly, but actually, they are written in detail. Even when they are written somewhat roughly, in an intermediate value, interpolation is carried out so that the practically useful target setting water-temperature (Ts) can be obtained. This is similar to each table referred hereafter.

In step S10, a temperature deviation ($\Delta T=Tw-Ts$) is computed from the cooling-water temperature (Tw) and the target setting water-temperature (Ts) retrieved from table ① shown in FIG. 11. In step S11, a reference control-valve angle ($\theta so$) corresponding to the engine speed (N) and the degree of throttle valve ($\theta T$) is retrieved from table ② shown in FIG. 12.

In step S12, a temperature deviation velocity (Tv) is computed from the last water-temperature (Two) and the now water-temperature (Tw). More specifically, the computing process of $Tv=\Delta T/\Delta t=(Two-Tw)/sec$ as shown in step S12 of FIG. 7 is performed.

In step S13, two data of the temperature deviation ($\Delta T$) and the temperature deviation velocity (Tv) which are respectively obtained in steps S10 and S12 are respectively performed with a comparative computation with a predetermined temperature deviation value ($\Delta TA$) and a predetermined temperature deviation velocity value (Tv). That is to say the comparative computation of $\Delta T \leqq \Delta TA$, $Tv \leqq TvA$ as shown in FIG. 7 is carried out.

In table ③ described below, the predetermined temperature deviation value ($\Delta TA$) and the predetermined temperature deviation velocity value (Tv) are defined as relatively lower values of deviation components boxed with bolded lines. The values less than the predetermined values are determined in step S13 (NO), whereupon the flow goes to step S21 shown in FIG. 8.

Figure 8:
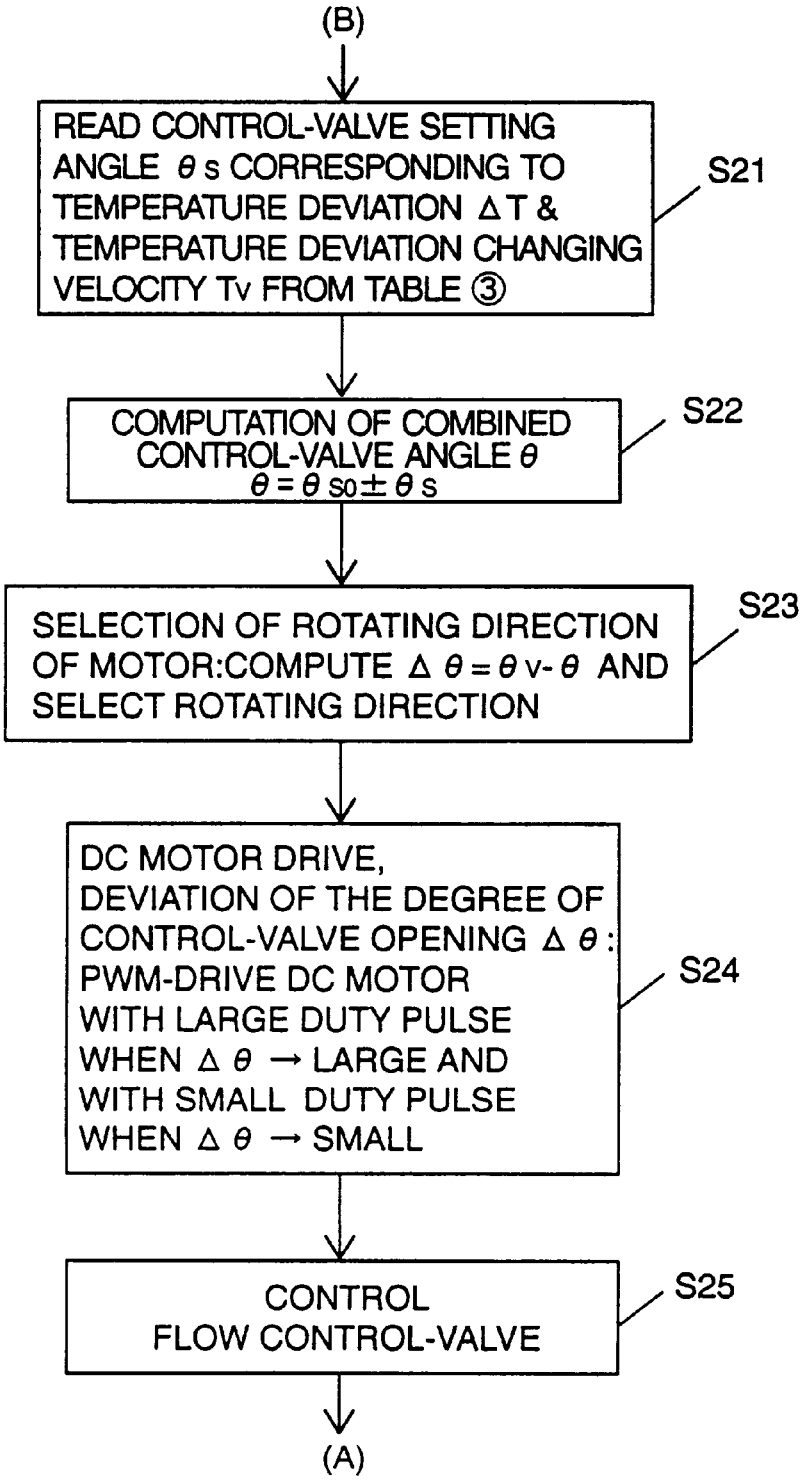
FIG. 8 is a flow chart for mainly explaining the action of a quick response control continued from the flow chart shown in FIG. 7.

Steps S21 to S25 shown in FIG. 8 are a routine of a quick response control for relatively quickly performing the flow control for the cooling water with the flow control valve.

In step S21, a control-valve setting angle ($\theta s$) corresponding to the temperature deviation ($\Delta T$) obtained in step S10 and the temperature deviation velocity (Tv) obtained in step S12 is retrieved from the table ③ shown in FIG. 13.

In table ③ shown in FIG. 13, the control-valve setting angles ($\theta s$) are written in matrix between the temperature deviation ($\Delta T$) and the temperature deviation velocity (Tv) similar to the tables ① and ②. A range ($\Delta 4$) of a smaller value of the temperature deviation ($\Delta T$) and a range (Tv4) of a smaller value of the temperature deviation velocity (Tv) which are boxed with bolded lines in the table ③ are defined as the predetermined temperature deviation value ($\Delta TA$) and the predetermined temperature deviation velocity value (Tv).

In step S22, the computation for a combined control-valve angle ($\theta$) is performed. This is the computation of $\theta=\theta so \pm \theta s$ performed between the reference control-valve angle ($\theta so$) retrieved in step S11 and the control-valve setting angle ($\theta s$) retrieved in step S21.

In step S23, the computation for selecting a rotational direction of the motor, namely the computation of $\Delta\theta=\theta v-\theta$ is performed. A value $\theta v$ used in this computation is obtained from the angle sensor 34*g* detecting the control-valve angle shown in FIG. 2. The rotational direction of the motor is decided on the basis of a negative value or a positive value resulted by the above computation.

Continuously, in step S24, the drive of the DC motor, namely a direct-current motor 31 shown in FIG. 2 is carried out. In this point, a duty pulse is produced in response with the obtained value $\Delta\theta$, in which a large duty pulse is produced when the value $\Delta\theta$ is large and a small duty pulse is produced when the value $\Delta\theta$ is small, and the DC motor is driven by the PWM signal.

Thereby, the butterfly valve 34*b* as the flow control valve is rotated in step S25. After the routine explained thus far, the flow goes back to step S7 in FIG. 7.

As a result of the comparative computation in step S13 in FIG. 7, upon the temperature deviation ($\Delta T$) and the temperature deviation velocity (Tv) being determined to be below the predetermined range (YES), the flow moves to step S31 in FIG. 9.

Figure 9:
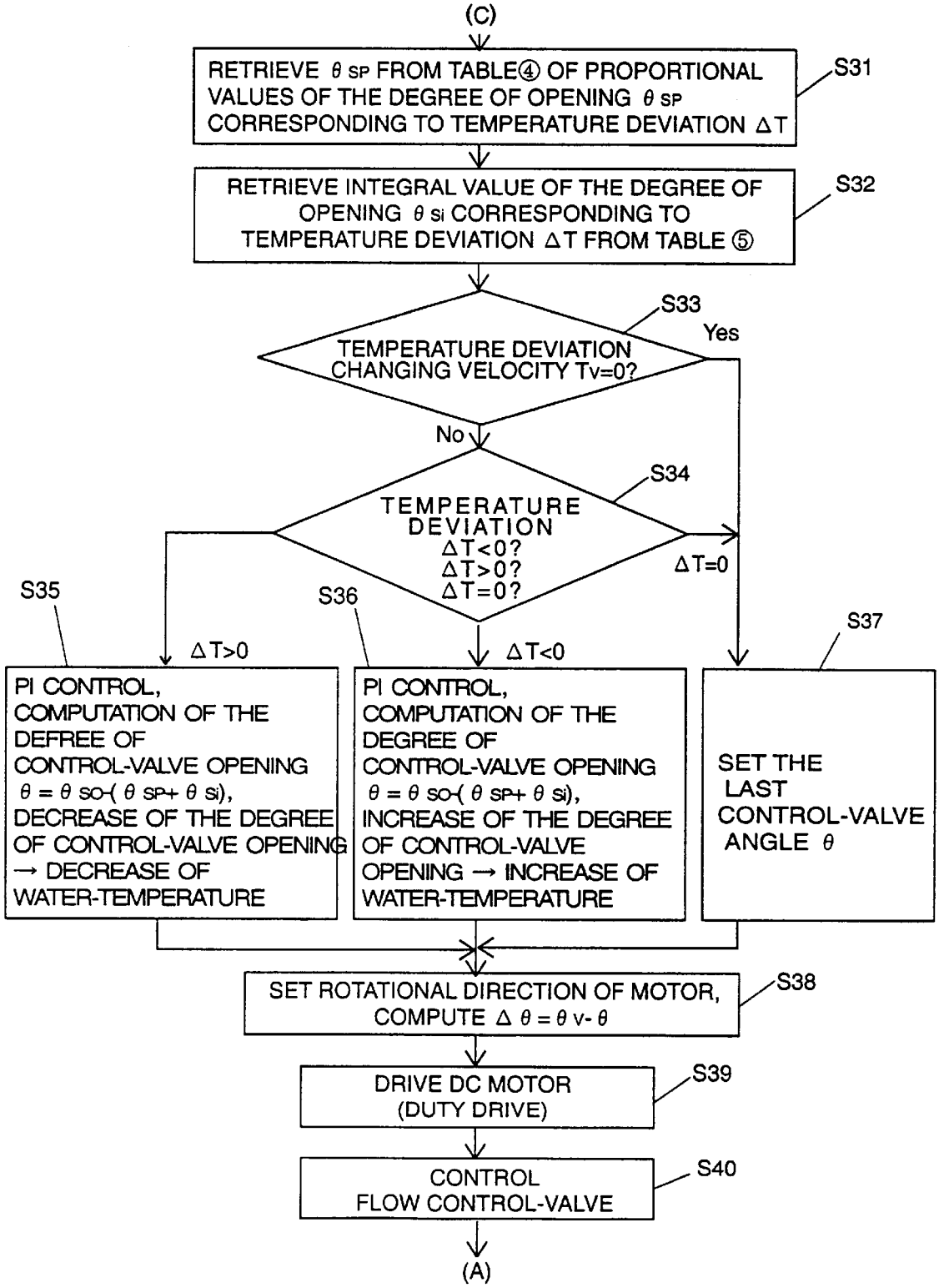
FIG. 9 is a flow chart for mainly explaining the action of a PI control continued from the flow chart shown in FIG. 7.

Steps S31 to S40 shown in FIG. 9 are a routine for performing a PI control including an integral control element which allows the flow control of the flow control valve for the cooling water to change at unit-times continuously and slightly.

In step S31, a proportional valve of the degree of valve opening ($\theta sp$) is retrieved from table ④ of proportional vales for the degree of valve opening ($\theta sp$) corresponding to the temperature deviation ($\Delta T$) as shown in FIG. 14.

In step S32, an integral value for the degree of valve opening ($\theta si$) is retrieved from table ⑤ of integral values of the degree of valve opening ($\theta si$), shown in FIG. 15, corresponding to the temperature deviation ($\Delta T$).

Upon going to step S33, whether or not a value of the temperature deviation velocity (Tv) obtained in step S21 is "zero" is determined. In this point, the value of the temperature deviation velocity Tv is determined to be "zero", whereupon the flow moves to step S37 explained below. When the value of the temperature deviation velocity Tv is determined not to be "zero", the flow goes to step S34.

In step S34, the determination as to the value of the temperature deviation $\Delta T$ found in step S10 is carried out. The flow goes to step S35 when $\Delta T>$zero is determined in step S34, step S36 when $\Delta T<$zero is determined, and step S37 when $\Delta T=$zero is determined.

In step S35, a value $\theta$ for decreasing the degree of control-valve opening is computed as the computation for the degree of control-valve opening. The computation for $\theta=\theta so-(\theta sp+\theta si)$ is performed with the reference degree of control-valve opening $\theta so$ retrieved in step S11, the proportional value for the degree of valve opening $\theta sp$ retrieved in step S31, and the integral value for the degree of valve opening $\theta si$ retrieved in step S32.

In step S36, a value for increasing the degree of control-valve opening is computed as the computation for the degree of control-valve opening. The computation for $\theta=\theta so+(\theta sp+\theta si)$ is performed.

And, in step S37, a process for using the last control-valve angle $\theta$ as it is is performed.

Going to step S38, the computation for $\Delta\theta=\theta v-\theta$ is performed with the control-valve angles ($\theta$) respectively found in step S35 to step S37 and the degree of control-valve opening ($\theta v$) obtained from the control-valve angle sensor 34*g*. The rotational direction of the motor is decided as a result of the computation.

By processing step S39 and step S40, the degree of flow-control-valve opening is controlled. The actions in step S39 and step S40 are the same as that in step S24 and step S25, so that the explanation is omitted.

Returning to step S7 in FIG. 7 after the above routine, the routine thus far is repeated until the engine is stopped.

Through the processes explained thus far, the temperature of the cooling water is conducted in a state that the changing of temperatures of the cooling water is forecast with the load information with respect to the engine. According to the circumstances, the flow control valve is controlled to be closed and opened by the control signal obtained by the first control-signal generating mode and the second control-signal generating mode, resulting in the improved responsibility of the control valve and the further enhanced precision of controlling the cooling water.

In the flow shown in FIG. 7 to FIG. 9, in order to improve the responsibility of the flow control valve, the degree of control-valve opening θs set according to the temperature deviation ΔT and the temperature changing velocity Tv is read and the degree of control-valve opening is controlled. A flow shown in FIG. 10 can be used for further simplifying the above manner.

Figure 10:
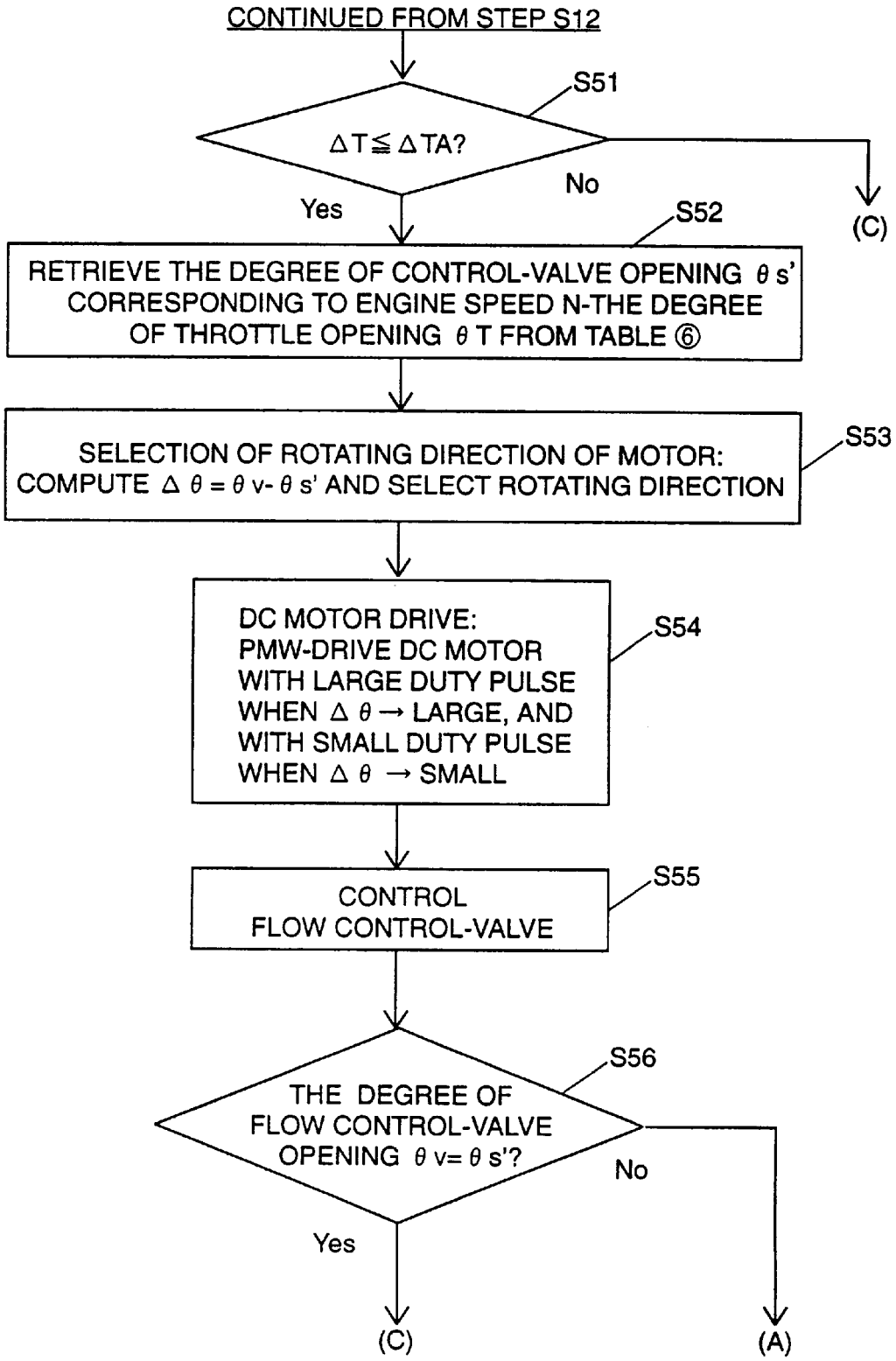
FIG. 10 is a flow chart showing an example flow instead of the flow chart shown in FIG. 8.

In FIG. 10, step S13 in FIG. 7 and steps S21 to S25 in FIG. 8 are transposed.

More specifically, step S51 in FIG. 10 is the same as step S13 in FIG. 7. When NO is determined in step S51, in step 52, a control valve angle θs' corresponding to the engine speed (N)-the degree of throttle opening (θT) as the load information of the engine is retrieved from table ⑥ shown in FIG. 16.

In step S53, the computation for selecting the rotational direction of the motor, namely, the computation for Δθ=θv−θs' similar to the case of step S23 is performed. The rotational direction of the motor is decided according to a positive value or a negative value as a result of the computation.

The processes of step S54 and step S55 are the same as that of step S24 and step S25, so that the explanation is omitted.

Moving step S56, whether or not the degree of flow-control-valve opening θv obtained from the angle sensor 34*g* is equal to the control-valve setting angle θs' found in step S52 (θs'=θv?) is determined. When unequal (NO) is determined, the flow returns to step S7 in FIG. 7. When equal (YES) is determined, the flow goes to step S31 in FIG. 9 to perform the PI control.

In either of the thus far explained flows shown in FIG. 7 to FIG. 9 and shown in FIG. 10, an angle of the butterfly valve 34*b* as the flow control valve is obtained as the degree of flow-control-valve opening θv from the angle sensor 34*g*, but a similar control can be performed without the use of the degree of flow-control-valve opening θv.

More specifically, where the angle sensor is used, basically, the degree of flow-control-valve opening θv can be received as a control deviation signal and a temperature can be controlled to be the target setting water-temperature Ts. Where the angle sensor is not used, the DC motor can be controlled with the PI duty pulse drive on the basis of the temperature deviation signal ΔT directly.

As in result, in the state that the control-valve angle sensor is not used, the control is performed by replacing table ③ shown in FIG. 13 with a table of DC motor drive PI duty values, thereby obtaining the same result.

FIG. 17 shows an example of a proportional duty table corresponding to the temperature deviation signal ΔT, used in the above manner. FIG. 18 shows an example of an integral duty table corresponding to the temperature deviation signal ΔT, used in the above manner.

Referring to the corresponded tables, a duty ratio of the PWM signal added to the bridge type DC motor drive circuit shown in FIG. 4 is time-controlled, thereby obtaining the same effects.

In the control unit 15, upon the actual cooling-water temperature Tw obtained from the temperature detecting element 13 and the target setting water-temperature Ts, when a value ΔT as the difference is larger than a predetermined value, namely is out of a range of predetermined temperatures, after a fixed time, an abnormal condition output can be generated.

By generating the abnormal condition output, the clutch control circuit 19 controls the clutch mechanism 32 to release, whereby the butterfly valve 34*b* can results in the valve opening state through the action of the return spring 34*e*. Therefore, the circulation of the cooling water is stimulated and the overheat of the engine can be avoided.

Although the description thus far has been referred to the preferred embodiment in which the cooling control system according to the present invention is applied to the engine for the vehicle, the present invention is not intended to be limited to the particular preferred embodiment, and can be applied to another engine and the same effects are obtained thereby.

Next, a second embodiment of the cooling control system for the engine will be described below.

In this structure, a PWM signal for a PTC-heater heating control is applied from the ECU 15 to a PTC drive circuit 18 described below. A PWM signal for a fan-motor drive control is applied from the ECU 15 to a fan-motor drive circuit 19 described below. The PTC drive circuit 18 and the fan-motor drive circuit 19 control the current supplied from the battery 20 with each PWM signal, and control current (electric power) is applied to the fan motor and a PTC heater provided in a flow control unit 111 and described below.

Figure 19:
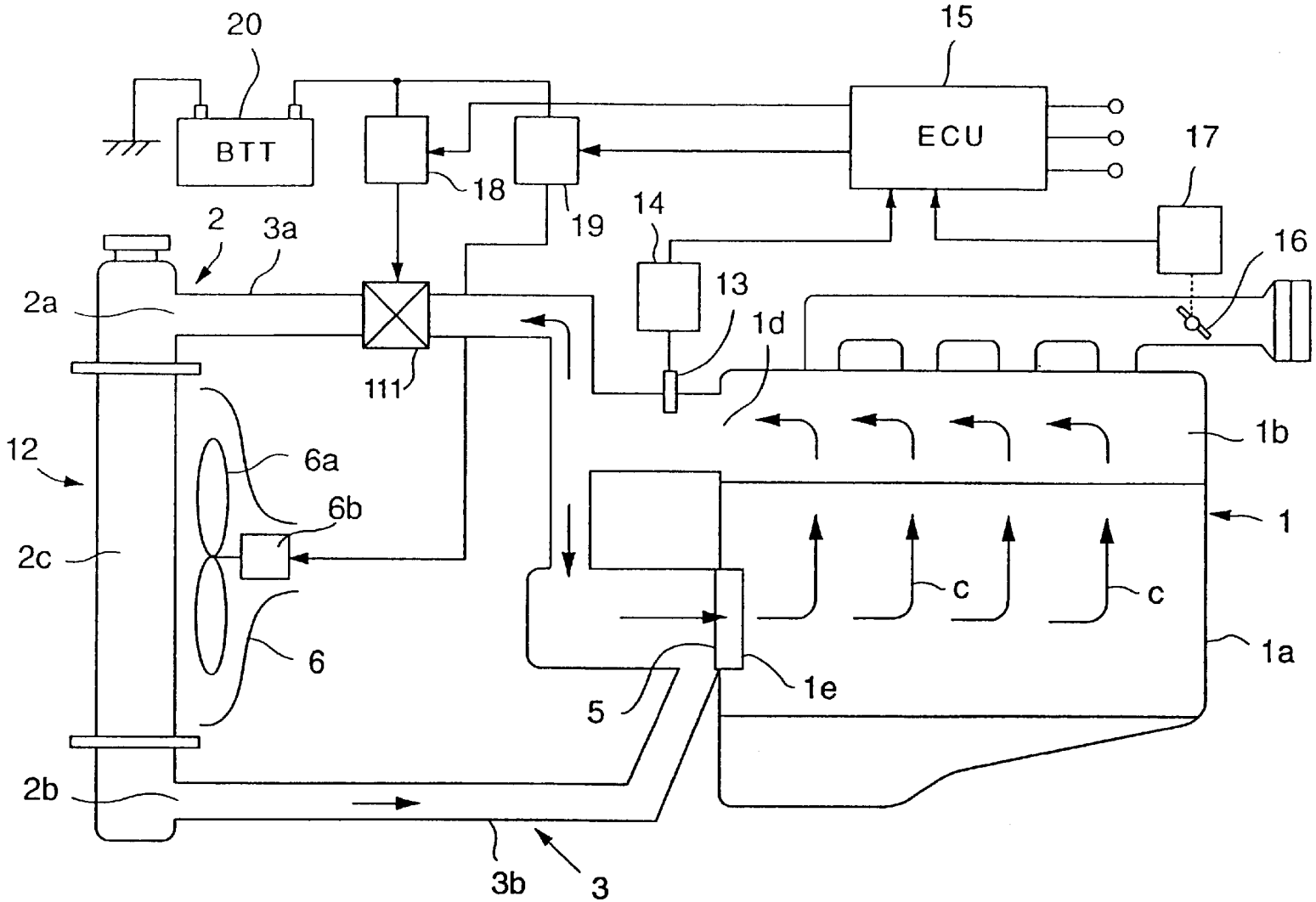
FIG. 19 is a block diagram showing another embodiment for a cooling control system according to the present invention, applied in an engine for a vehicle.
Figure 20B:
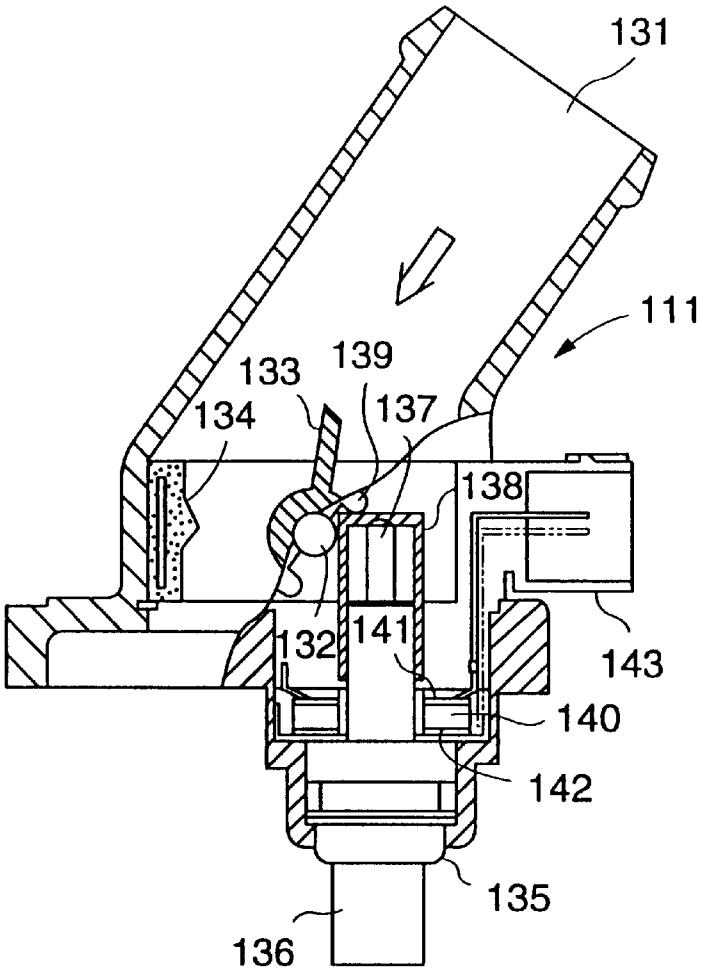
FIGS. 20 are block diagrams of a flow control unit in a first structure used in the system shown in FIG. 19 with a partial cross-section.
Figure 20A:
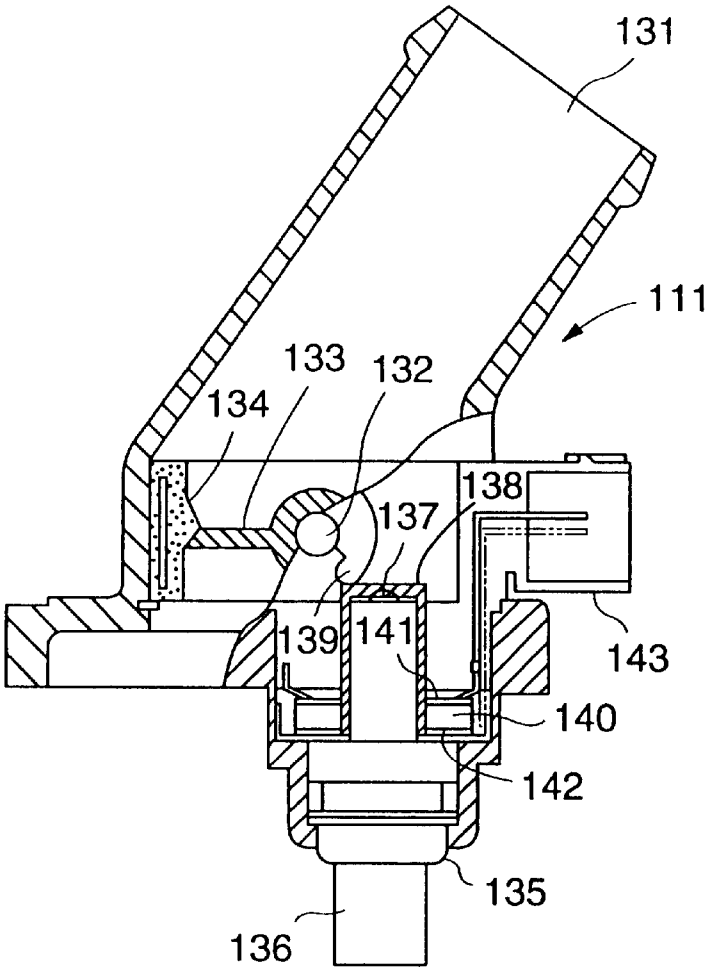

FIGS. 19 show a first structure of the flow control unit 111 with a cross-section. In the flow control unit 111, a cylinder portion 131 connected toward the engine is provided. In the lower portion of the cylinder portion 131, a shaft 132 is disposed at the central area, and a butterfly valve 133 rotatably supported by the shaft 132 is located. The butterfly valve 133 is in the closing state as shown in FIG. 20(*a*) by a return spring (not shown) disposed on the shaft 132 while a thermo-element, described below, is not being operated. In the opening state of the butterfly valve 133, a valve seat 134 formed of a flexible material and placed in the lower portion of the cylinder portion 131 is in contact with a valve body.

The valve body of the butterfly valve 133 is formed in a disc shape as well-known, and the flow of the cooling water is controlled by the angle of the plane direction of the valve body, formed by a rotational angle of the shaft 132, with respect to the flowing direction of the cooling water. More specifically, when an angle of the plane direction of the valve body is approximately zero with respect to the flowing direction of the cooling water, the valve is opened. When an angle of the plane direction is approximately perpendicular to the flowing direction of the cooling water, the valve is closed. The flow of the cooling water is approximately linearly controlled in relation to the angle taken between zero and 90 degrees.

A thermo-element 135 is placed in the cooling-water outflow side, namely the radiator side of the butterfly valve 133. In an example shown in FIG. 20, the thermo-element 135 is placed in the cooling water in the cooling-water conduit 3*a* so as to be in thermal-contact with the cooling water.

In the thermo-element 135, a tubular wax-element 136 enclosing wax as a thermal expansive body is disposed to locate in the cooling water. In the wax-element 136, a piston member 137 embedded to move in a vertical direction in accordance to the degree of wax expanding is placed.

On the upper portion of the piston member 137, a cylindrical retainer 138 is disposed to surround the piston member 137. The retainer 138 is abutted to a cam member 139 placed on the same axis as that of the shaft 132 by upward movement of the piston member 137, and rotated about the shaft 132.

With the rotation of the cam member 139 by the working of the piston member 137, the butterfly valve 133 is opened as shown in FIG. 20(*b*), and the cooling water circulates.

A ring-shaped PTC heater 140 including a thermistor, having the positive temperature coefficient character, as a heating element is placed to circle the wax-element 136. On and beneath the PTC heater 140, a pair of ring-shaped electrodes 141 and 142 for applying current to the PTC heater 140 is placed. Current flows from a socket 143 formed on a side face of the flow control unit 111 through a lead wire to the electrodes 141 and 142.

As a consequence, the aforementioned wax-element 136 is heated by energizing the PTC heater 140 via the socket 143. Then, as described hereinbefore, the piston member 137 is projected upward by the thermal expansion of wax enclosed in the wax-element 136, and the butterfly valve 133 is opened.

According to the flow control unit 111 in the first structure shown in FIGS. 20, the degree that the butterfly valve 133 is opened can be controlled in accordance to the temperature of the cooling water and the electric energy applied to the PTC heater.

Figure 21:
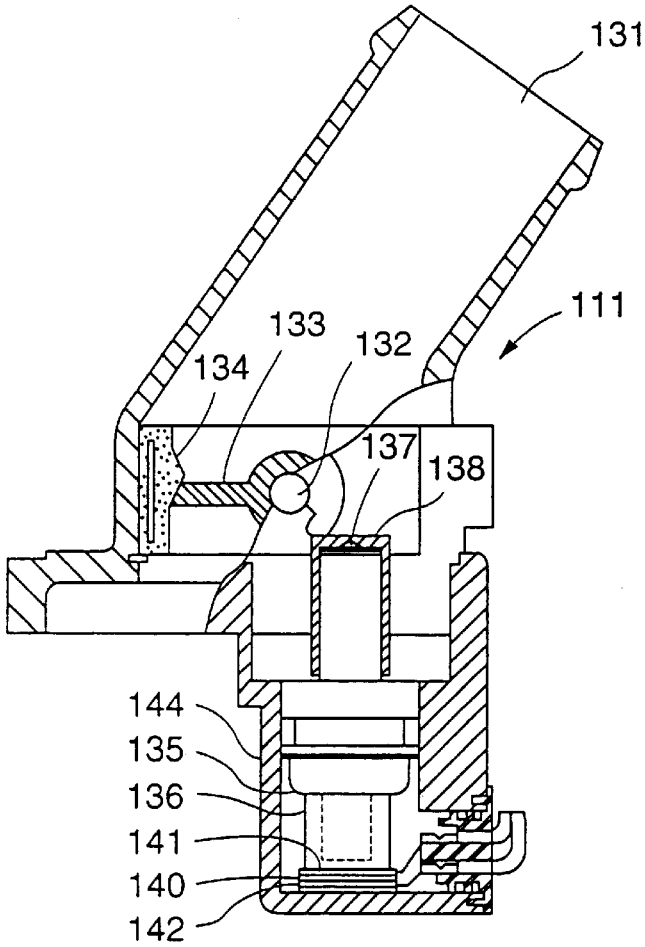
FIG. 21 is a block diagram of a flow control unit in a second structure used in the system shown in FIG. 19 with a partial cross-section.

FIG. 21 shows a second structure of the flow control unit 111 with a cross-section. Incidentally, in FIG. 21, the same reference numerals will be used to designate the same components as those in FIG. 20, so that the in-depth description will be omitted.

The thermo-element 135 in the flow control unit 111 shown in FIG. 21 is thermally insulated from the cooling water. For this reason, a wall portion 144 cutting off the thermo-element 135 from the heat of the cooling water is disposed in the exit side of the butterfly valve 133. The disc-shaped PTC heater 140 is sandwiched between the disc-shaped electrodes 141 and 142 and placed in the bottom portion of the thermo-element 135.

The wall portion 144 is formed of materials such as synthetic resin, thereby thermal insulating properties are enhanced.

FIG. 21 shows the closing state of the butterfly valve 133. Upon energizing the PTC heater 140, the piston member 137 is projected upward by the thermal expansion of wax enclosed in the wax-element 136. The butterfly valve 133 is opened by the same action as that of the case explained in FIG. 20(*b*).

According to the flow control unit 111 in the second structure shown in FIG. 21, the degree that the butterfly valve 133 is opened is controlled in accordance to the electric energy applied to the PTC heater irrelevant of the temperature of the cooling water.

Figure 22:
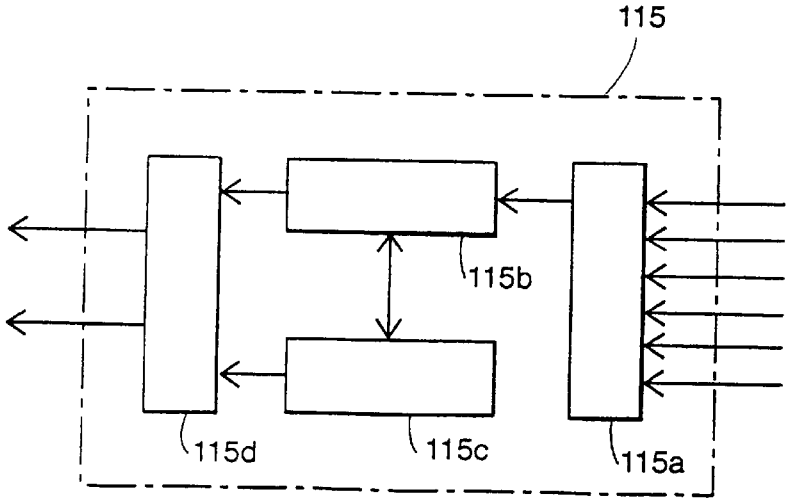
FIG. 22 is a block diagram showing a basic design of an engine control unit (ECU) shown in FIG. 19.

FIG. 22 shows a basic design of ECU 115 shown in FIG. 19. The ECU 115 includes a signal processing part 115*a* for converting a signal, sent from each sensor, to a digital signal recoganizable by the ECU; a comparison part 115*b* for comparing the input data processed in the signal processing part 115*a* with various data, described hereinafter, stored in a table form in a memory part 115*c*; and a signal processing part 115*d* for computing the compared result by the comparison part 115*b* and outputting it as the control signal. The PWM signals outputted from the signal processing part 115*d* are sent to a PTC drive circuit 118 and a fan-motor drive circuit 119 shown in FIG. 23 and FIG. 24.

Figure 23:
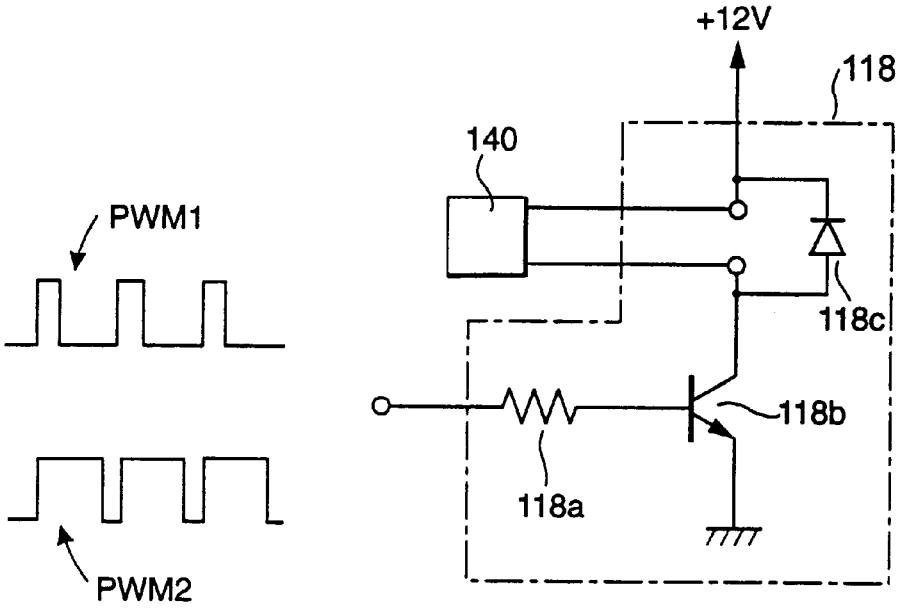
FIG. 23 is a connection diagram showing a PTC heater drive circuit for driving a PTC heater.

The PTC drive circuit 118 shown in FIG. 23 includes an NPN-type transistor 118*b*. The PWN signal outputted from the above signal processing part 115*d* is sent through a base input resistor 118*a* into a base of the transistor 118*b*. A collector of the transistor 118*b* is connected to the battery through the PTC heater 140 placed in the flow control unit 111, and an emitter is connected to a reference point of potential (a body of the vehicle). A diode 118*c* for protection is connected in shunt with respect to the PTC heater 140.

As shown as PWM land PWM 2 in FIG. 23, a pulse signal for a heater heating control in which a duty value is controlled is sent from the ECU 115 to the base of the transistor 118*b*. Therefore, the transistor 118*b* passes current to the PTC heater 140 in response to the duty value of the pulse signal, whereby a heat value of the PTC heater 140 is controlled.

Figure 24:
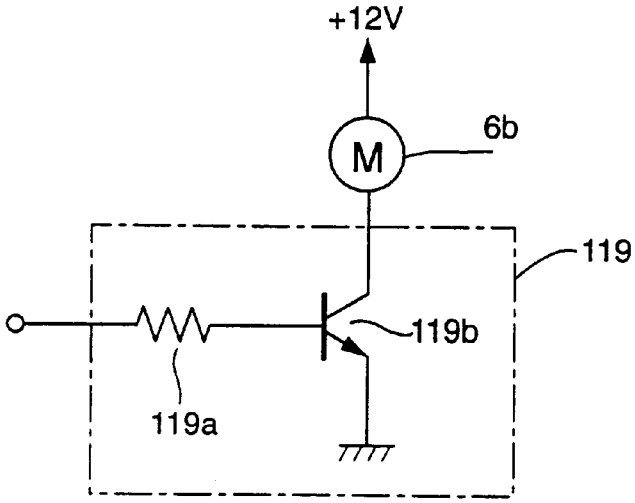
FIG. 24 is a connection diagram showing a motor drive circuit for driving a fan motor.

Similarly, the fan-motor drive circuit 119 shown in FIG. 24 includes a NPN type transistor 119*b*. The PWN signal outputted from the above signal processing part 115*d* is sent through a base input resistor 19*a* into a base of the transistor 119*b*. A collector of the transistor 119*b* is connected to the battery through the fan motor 6*b*, and an emitter is connected to the reference point of potential (a body of the vehicle).

Similar to PWM land PWM 2 shown in FIG. 23, a pulse signal for a fan-motor control in which a duty value is controlled is sent from the ECU 115 to the base of the transistor 119*b*. Therefore, the transistor 119*b* passes current to the fan motor 6*b* in response to the duty value of the pulse signal, whereby the rotational speed of the fan motor 6*b* is set and the dissipation efficiency by the radiator is controlled.

Operation in the first structure of the flow control unit (FIG. 20)

The operation using the first structured flow control unit shown in FIG. 20 in which the degree of butterfly-valve opening is controlled in response to the temperature of the cooling water and the electric energy supplied to the PTC heater will be below with reference to the control processes shown in FIG. 25.

Figure 25:
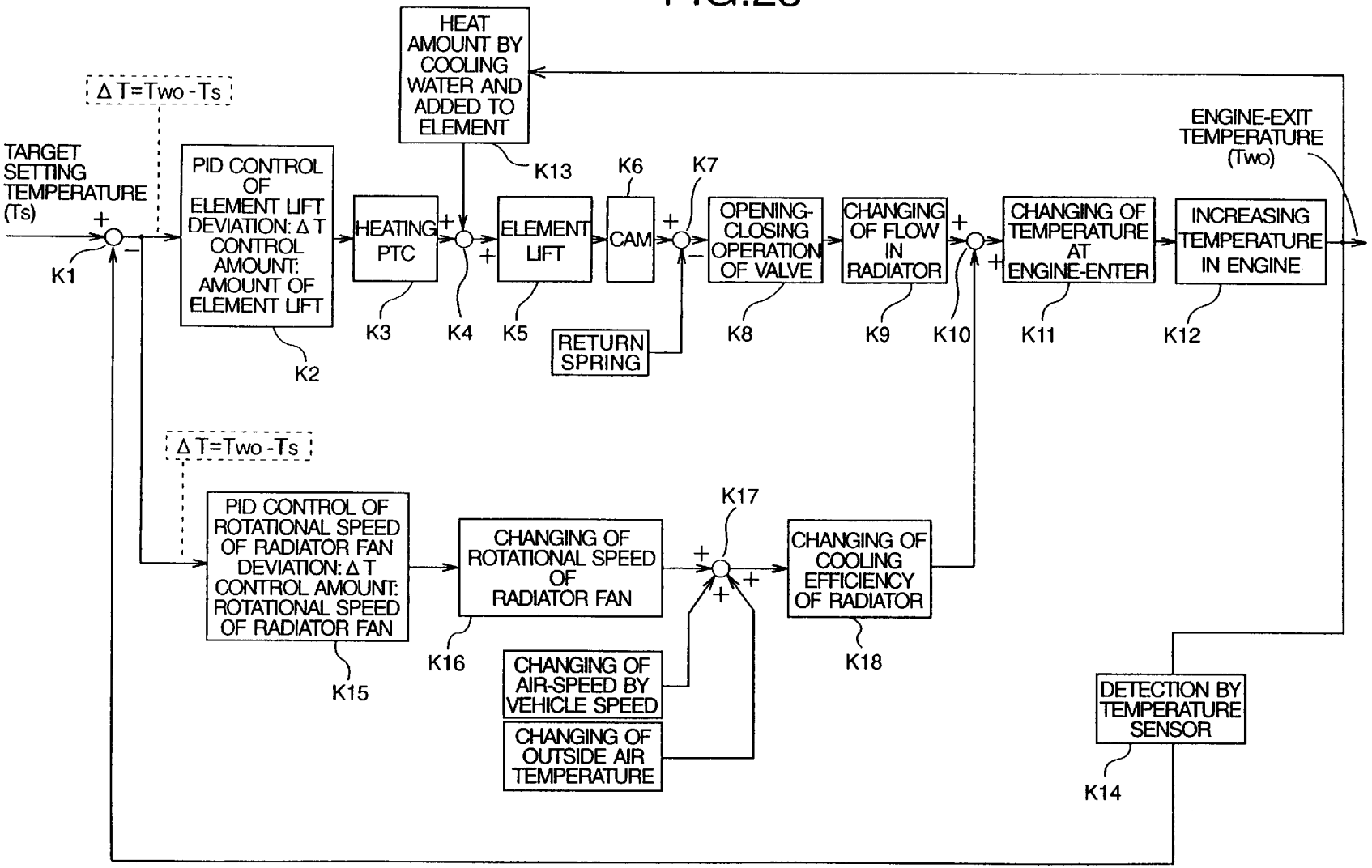
FIG. 25 is an explanatory control-process diagram in the use of the flow control unit in the first structure shown in FIGS. 20.

An example of FIG. 25 shows the case that the cooling-water temperature at the exit of the engine is controlled to be within a predetermined range. With a target setting temperature Ts for the cooling-water temperature at the exit of the engine, in process K1, a deviation ΔT (=Two−Ts) between the target setting temperature Ts and a cooling-water temperature Two obtained from the temperature sensor 13 measuring the cooling-water temperature at the exit of the engine is computed.

In process K2, the amount of element lift required to the thermo-element 135 in accordance to the above deviation ΔT is computed. In this point, the amount of element lift is roughly decided by the cooling-water temperature Two, the flow of the cooling water (dependent upon the engine speed), and the duty value of the PWM signal for energizing the PTC motor. And, the duty value of the PWM signal for energizing the PTC motor is decided by these parameters.

Note that computation of the well-known PID (the amount of follow-up control) is used in the case of the determination of the duty value of the PWM signal. In many cases, a control with only the aforementioned parameters cannot be performed due to various disturbance elements in actuality. Therefore, in order to correct delay in time of control system, minute correction in the positive-negative direction is added to the duty vale of the PWM signal.

The PWM signal for the PTC-heater heating control is sent to the PTC drive circuit 118 shown in FIG. 23, whereby the PTC heater heats in process K3, and the thermo-element is lifted in process K5. In this case, as explained hereinafter, another requirement regarding the amount of element lift is added in process K4.

In process K6, mechanical linear movement is converted into rotational movement through the cam due to the element lift. More specifically, the shaft 132 of the butterfly valve 133 is rotated. The return spring is disposed on the shaft 132 of the butterfly valve as described hereinbefore. In process K7, the return element by the return spring is incorporated, and in process K8, the opening and closing operation of the butterfly valve is carried out.

In process K9, the flow of the cooling water flowing into the radiator is changed. As shown in process K11, the temperature of the cooling water at the entrance of the engine is changed. In this case also, as explained hereinafter, another requirement is added in process K10 for changing the temperatures of the cooling water.

In process K12, the temperature of the cooling water is changed by the heat exchange while the cooling water is passing through the engine, and results in the temperature at the exit of the engine.

At this time, in the first structured flow control unit, the thermo-element 135 simultaneously receives the heating action by the PTC heater 140 and the action by the temperature of the cooling water, resulting in the element lift. In other words, the temperature at the exit of the engine acts on the thermo-element as shown in process K13. In process K4, an amount of heat (the temperature and the flow) in process K13 is added to an amount of heat by the PTC heater, whereby the amount of element lift is determined.

The temperature of the cooling water at the exit of the engine is detected by the temperature sensor as shown in process K14. In process K1, the detected temperature at the exit is added as a negative factor with respect to the target setting temperature Ts, and the deviation ΔT is generated.

In process K15, the information of the deviation ΔT used for computing the duty value of the PWM signal corresponding to the rotational speed of the fan motor that drives the radiator fan. In this case, the computation of PID is used similarly to process K2.

The PWM signal for driving the fan motor which is generated as explained thus far is supplied to the fan-motor drive circuit 119 shown in FIG. 24, so that the rotational speed of the radiator fan is adjusted (changed) as shown in process K16. In this case, as shown in process K17, elements such as the changing of air-speed caused by vehicle speed, and the changing of outside-air-temperature being incorporated, a cooling effect by the radiator is changed as shown in process K18. The elements of the cooling efficiency incorporate into the changing element of the flow of the cooling water flowing into the radiator in the aforementioned process K10, and acts on the changing of the temperature at the entrance of the engine.

Operation in the second structure of the flow control unit (FIG. 21)

The operations using the second structured flow control unit shown in FIG. 21 in which the degree of butterfly-valve opening is controlled in response to the electric energy supplied to the PTC heater, independent from the temperature of the cooling water, will be explained below with reference to the control processes shown in FIG. 26.

Figure 26:
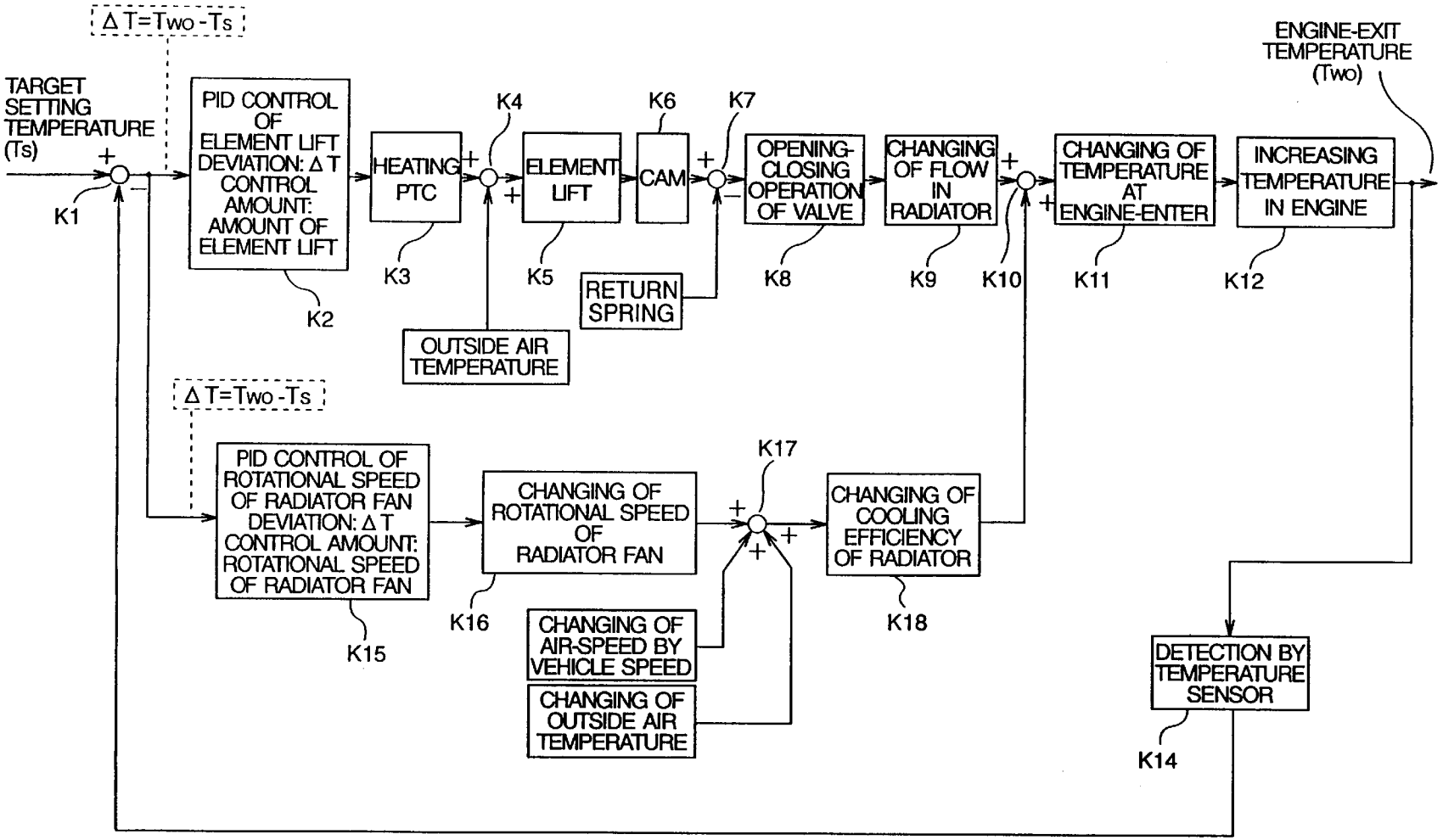
FIG. 26 is an explanatory control-process diagram in the use of the flow control unit in the second structure shown in FIG. 21.

Similar to the former example, an example of FIG. 26 shows the case that the cooling-water temperature at the exit of the engine is controlled to be within a predetermined range. In processes K1 to K18 shown in FIG. 26, the same reference numerals are used to designate the same processes as those shown in FIG. 25, so that the overlapped explanation is omitted.

In the flow control unit in the second structure shown in FIG. 21, the thermo-element 135 is disposed to be thermally insulted from the cooling water as described hereinbefore, therefore a process indicated with K13 is substantially deleted comparing with the example shown in FIG. 25. That is, the process in which the temperature at the exit of the engine acts on the thermo-element is deleted.

In process K4 of FIG. 26, the outside air temperature acts on the thermo-element 135, so that the element of the outside air temperature is incorporated with respect to an amount of heat by the PTC heater, and the amount of element lift is decided.

Figure 27:
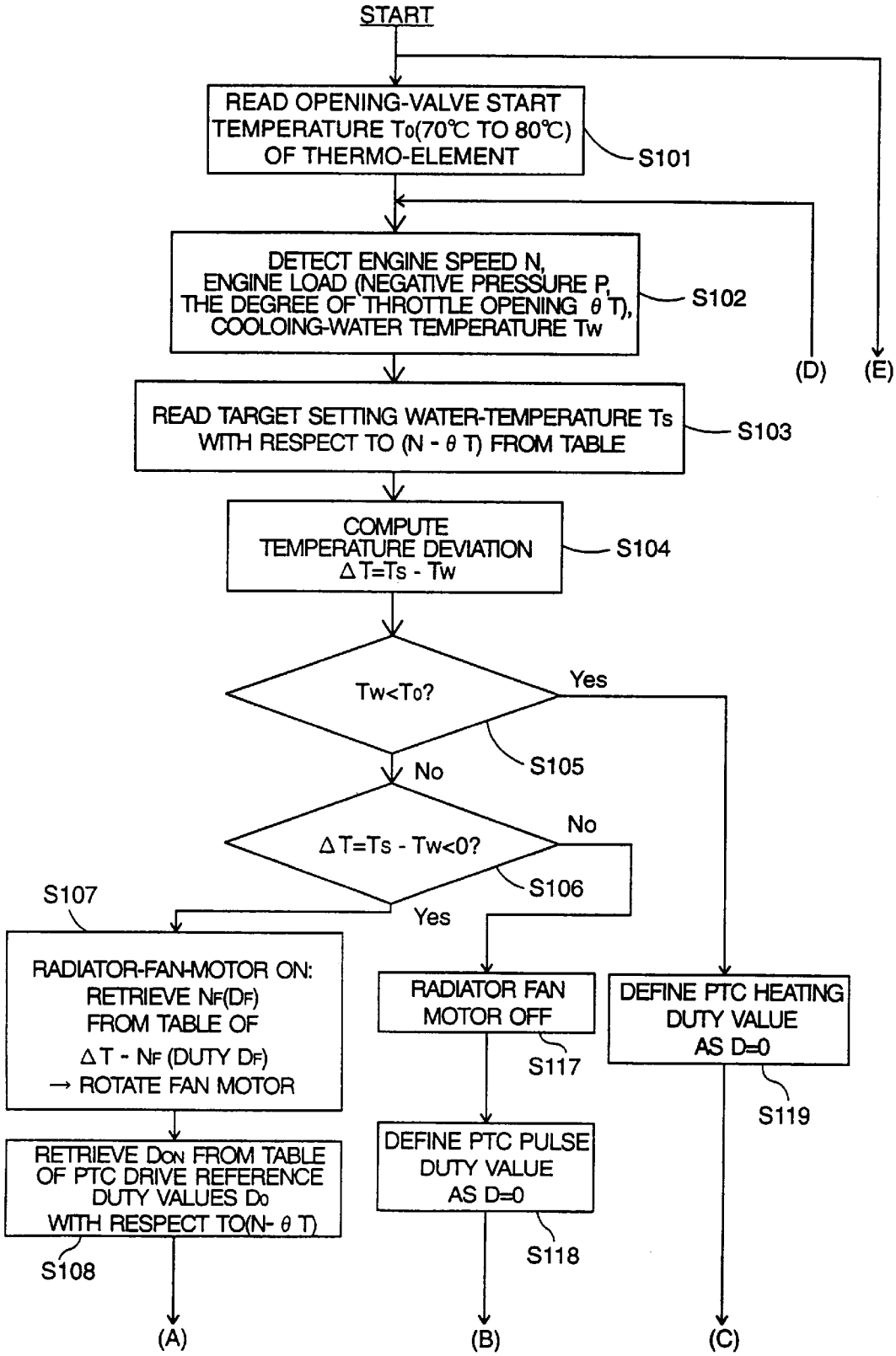
FIG. 27 is a flow chart for explaining the operations performed in ECU.
Figure 28:
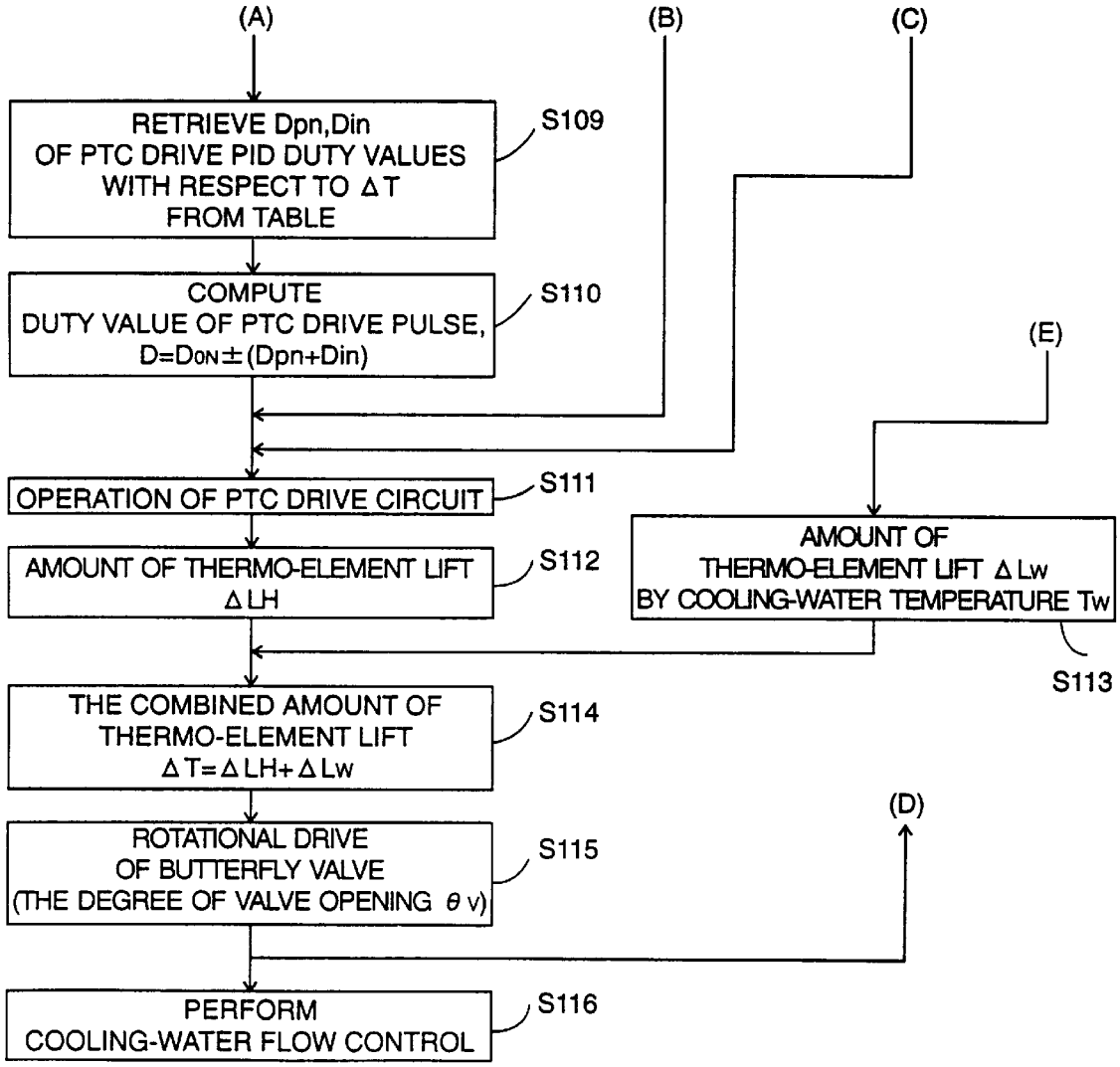
FIG. 28 is a flow chart continued from the flow chart in FIG. 27 for explaining the operations performed in ECU.

The cooling device according to the present invention carries out the cooling operation with the control processes explained thus far and shown in FIG. 25 and FIG. 26. A flow of the control mainly performed by the ECU 115 which is shown in FIG. 27 and FIG. 28 will be explained below. Incidentally, the control flow shown in FIG. 27 and FIG. 28 mainly corresponds to K1 to K15 of the control processes shown in FIG. 25 and FIG. 26. The control using the flow control unit in the first structure (FIG. 20) and the control using the flow control unit in the second structure (FIG. 21) have a slightly different control-flow from each other, so both control flows will be separately explained below.

Control flow in using the flow control unit in the first structure (FIG. 20)

In step S101 of FIG. 27, the ECU 115 reads an opening-valve start temperature To (from 70° C. to 80° C.) of the thermo-element. In step S102, the ECU 115 detects the engine speed N; the degree of throttle opening θT, outputted from the throttle opening-level sensor 17 detecting the negative pressure P of the intake air as the engine-load information; and the cooling-water temperature Tw from the temperature sensor 13.

In step S103, the ECU reads a target setting water-temperature Ts of the cooling water at the exit of the engine, written with the relationship between the engine speed N and the degree of throttle opening θT, from a table stored in the memory part 115*c* shown in FIG. 22. Continuously, in step S104, the ECU computes a deviation ΔT (=Ts−Tw) between the target setting water-temperature Ts read from the above table and the cooling-water temperature Tw from the temperature sensor 13, detected in step S102.

In step S105, with the opening-valve start temperature To of the thermo-element, obtained in step S101, and the cooling-water temperature Tw detected in step S102, the ECU determines whether or not the condition is Tw<To. Where the result is NO, the flow moves to step S106. This means the state in which an actual measured value Tw of the cooling water equals to the opening-valve start temperature To by the thermo-element or in which the cooling-water temperature w is higher than the opening-valve start temperature To by the thermo-element.

In step S106, whether of not the condition is ΔT=Ts−Tw<zero is determined with the deviation ΔT computed in step S104. When the condition is YES, the flow goes to step S107. This means the state in which the target setting water-temperature Ts equals to the actual cooling-water temperature Tw or in which the actual cooling-water temperature Tw is higher than the target setting water-temperature Ts, therefore the cooling water is needed to be cooled quickly.

In step S107, after receiving the above condition, the ECU performs a step for generating the PWM signal for driving the fan motor 6*b*. More specifically, a duty value is retrieved from a table written thereon with the temperature deviation ΔT computed in step S104 and DF (the engine speed NF) being the duty value of the PWM signal corresponding to the temperature deviation ΔT, and the PWM signal corresponding to the retrieved duty value is produced. The PWM signal is supplied to the fan-motor drive circuit 119 shown in FIG. 24, whereby the fan motor 6*b* is driven to rotate.

Continuously, in steps S108 and S109, a step for generating the PWM signal for controlling electric power supplied to the PTC motor is performed. More specifically, in step S108, a duty value Don is retrieved from a duty value Do table, written thereon with duty values to obtain the setting water-temperature Ts, with respect to the relationship between the engine speed N and the degree of throttle opening θT obtained in step S102.

Going to step S109 of FIG. 28, the computation of PID is performed. More specifically, a proportional duty value Dpn is retrieved from a table written thereon with proportional duty values of the PWM signal for driving the PTC heater which corresponds to the temperature deviation ΔT, and an integral duty value Din is retrieved from a table written thereon with integral duty values of the PWM signal for driving the PTC heater which corresponds to the temperature deviation ΔT.

In step S110, the computation for D=Don±(Dpn+Din) is performed so as to find a duty value D of the PTC drive pulse from the duty value, obtained in step S108, and the proportional duty value Dpn and the integral duty value Din retrieved in step S109.

In step S111, the PWM signal of the duty value D is sent to the PTC drive circuit 118 shown in FIG. 23. The current controlled by the duty value D is applied to the PTC heater 140, so that the thermo-element 135 is heated in response to the volume of current (electric energy) supplied, and the amount of lift ΔLH of the thermo-element 135 is decided in step S112.

In using the first structured flow control unit shown in FIG. 20, the thermo-element 135 senses the cooling-water temperature, and the amount of element lift is controlled with the cooling-water temperature in parallel with the actions caused by the aforementioned steps. In step S113 shown in FIG. 28 subsequent to reference letter E of FIG. 27, the amount of thermo-element lift ΔLw caused by the cooling-water temperature Tw acts, and is added to the amount of lift ΔLH of the thermo-element 135 which is decided in step S112. As shown in step S114, the combined amount of thermo-element lift ΔL is defined as ΔL=ΔLH+ΔLw.

Based on the combined amount of lift ΔL, the butterfly valve 133 is rotationally driven in step S115, and the degree of butterfly-valve opening is defined as θv. The flow returns from step S115 through reference letter C of FIG. 27 to step S102 and circulates.

As shown in step S116, the flow of the cooling water is controlled, and the cooling-water temperature at the exit is controlled to converge on the target setting water-temperature Ts eventually.

The explanation thus far shows the control flow when the cooling water is needed to be cooled in the state that the cooling-water temperature is higher than a predetermined temperature in step S106.

Another control flow in a state other than the aforementioned state will be explained. When the determination in step S106 is NO, that is when the actual cooling-water temperature Tw is lower than the target setting water-temperature Ts, the flow goes into the routine of step S117. In step S117, the motor driving the radiator fan turns off. In step S118, the duty value of the PWM signal for controlling current applied to the PTC motor is defined as zero. In other words, in this case, the flow moves to step S111 via reference letter B shown in FIG. 27 and FIG. 28, and the current applied to the PTC motor is in a breaking state. Therefore, the radiator fan **6*b* stops and also the heating of the PTC heater 140 stops, so that the butterfly valve 133** is propelled toward the direction of valve closing. Thereby, until the actual cooling-water temperature Tw exceeds the target setting water-temperature Ts, the dissipation efficiency is decreased to rapidly increase the cooling-water temperature.

When the actual measured value Tw of the cooling-water temperature is lower than the opening-valve start temperature To by the thermo-element in step S105, that is when the determination is YES, the flow goes into the routine of step S119. The duty value of the PWM signal for controlling current applied to the PTC heater is defined as zero. In this case, the flow goes to step S111 via reference letter C shown in FIG. 27 and FIG. 28. The current applied to the PTC heater is in the breaking state. Therefore, the heating of the PTC heater is stopped so as to increase the cooling-water temperature rapidly.

Control flow in using the flow control unit in the second structure (FIG. 21)

The control flow with the use of the second structured flow control unit shown in FIG. 21 in which the degree of butterfly-valve opening can be controlled mainly in accordance to electric energy applied to the PTC heater and independent from the temperature of the cooling water is explained below.

In the control flow, a routine formed with reference letter E in the flow chart shown in FIG. 27 and FIG. 28 is omitted substantially. More specifically, the amount of thermo-element lift ΔLH caused by the cooling-water temperature Tw does not act in step S113, so that the control is performed with only the amount of thermo-element lift ΔLH dependent upon the PTC heater shown in step S112.

According to the cooling control system in the embodiments described thus far, the target setting water-temperature is derived from parameters such as the engine speed and the load information (the degree of throttle opening θT), and the deviation of the cooling-water temperature with respect to the target setting water-temperature is computed, and then the amount of current supplied to the PTC heater for heating the thermo-element is controlled. As a result, the opening state of the butterfly valve is controlled and the dissipation efficiency of the cooling water is controlled. In addition, the rotation of the fan motor is controlled, so that an appropriate temperature for operating the engine is ensured all the times.

In the flow chart of FIG. 27 and FIG. 28, it is explained that the tables stored data are constructed and the required data is read from the table, but the data may not necessarily be stored in a table form. The data can be fetched by the computing processes.

The embodiments where the cooling control system of the present invention is applied to the engine for the vehicle have been described, but the present invention is not intended to be limited to a specific use as described hereinbefore, and the same action and effects can be obtained if the present invention is applied to another engine.

As is clear from the aforementioned description, according to a cooling control system and a cooling control method relating to the present invention, a target setting temperature of a cooling medium is found on the basis of load information regarding at least an engine, and a temperature deviation and a changing velocity of the temperature deviation are found from the target setting temperature and an actual temperature of the cooling medium, so that an appropriate control form can be selected on the basis of the found values.

A PI control is performed as a first control signal generating mode and a quick response control is performed as a second control signal generating mode, so that the temperature conduct with high precision can be performed while the changing of the temperature of the cooling water is being forecast.

In consequence, the occurrence of hunting of the temperature of the cooling water is avoided, resulting in the improved fuel efficiency and the decrease of hazardous exhaust fumes.

An actuator controlling a flow control means is composed of a direct-current motor, a clutch mechanism and a deceleration mechanism, so that the overall actuator is small in size while drive torque of the flow control means is obtained sufficiently, in which when it is employed for an engine for a vehicle, the occupied volume is decreased.

In addition, with using a return spring propelling the flow control means in an opening direction of the valve, disadvantages such as the overheat of the engine that is caused by the occurrence of trouble are prevented, and a fail-safe function is exploited.

Moreover, the cooling control system for an engine according to the present invention is characterized by adopting a conformation in which a butterfly valve is driven with a thermo-element, and structuring that the degree of butterfly-valve opening is controlled by heating the thermo-element on the basis of the operation parameters of the engine.

In consequence, as described in "SUMMARY OF THE INVENTION", the characteristics of the butterfly valve which is capable of extremely decreasing rotation torque for adjusting the flow of the cooling water is used, so that there is no element of mechanical stress, resulting in the improved life of the device and reliability.

It should be mentioned that the structure of the overall system can be simplified, thereby achieving the cooling control system with the reduction of costs.

What is claimed is:

1. A cooling control system for an engine, in which a circulating passage of a cooling medium is formed between a fluid conduit formed in the engine and a fluid conduit formed in a heat exchanger, and heat generated in the engine is dissipated with the heat exchanger by circulating the cooling medium in the circulating passage, comprising:

a flow control mechanism controlling the flow of the cooling medium in the circulating passage between the engine and the heat exchanger in accordance with the degree of valve opening;

an information extracting mechanism extracting at least load information in respect of the engine and temperature information of the cooling medium; and a control unit finding a target setting temperature of the cooling medium on the basis of the load information, and finding a temperature deviation of the temperature information of the cooling medium from the target setting temperature, and generating a control signal for an actuator of said flow control mechanism on the basis of the relationship between the temperature deviation and a changing velocity of the temperature deviation.

2. The cooling control system for the engine according to claim 1, wherein said load information is generated from at least engine speed and information of the degree of throttle-valve opening.

3. The cooling control system for the engine according to claim 1 or claim 2, wherein said control unit operates a first control signal generating mode for generating a control signal for the actuator when said temperature deviation and said changing velocity of the temperature deviation are below predetermined values, and a second control signal generation mode for generating a control signal for the actuator when said temperature deviation and said changing velocity of the temperature deviation exceed predetermined values.

4. The cooling control system for the engine according to claim 3, wherein said first control signal generating mode includes an integral control element continuously and slightly changing the flow of the cooling medium, controlled by said flow control means, at unit-times in response to said temperature deviations; and wherein said second control signal generating mode generates the control signal for the actuator on the basis of flow setting data of the cooling medium which is read out from a map written to correspond with said temperature deviation and said changing velocity of the temperature deviation.

5. The cooling control system for the engine according to claim 1, further comprising a sensor showing the flow of the cooling medium controlled by said flow control mechanism, wherein information obtained from the sensor is used for a computing process in said control unit.

6. The cooling control system for the engine according to claim 5, wherein said flow control mechanism comprises a butterfly valve which is disposed in a tubular cooling-medium conduit and of which an angle in the plane direction is changed with respect to a flowing direction of the cooling medium; and wherein said sensor showing the flow of the cooling medium is an angle sensor generating information on rotational angles of said butterfly valve.

7. The cooling control system of the engine according to claim 1, wherein said actuator comprises a direct-current motor driven to be rotated on the basis of the control signal outputted from said control unit, a clutch mechanism transferring and releasing a rotational driving force of said direct-current motor, and a deceleration mechanism decelerating rotational speed of the direct-current motor through the clutch mechanism, and wherein said flow control mechanism is provided with a return spring propelling said flow control mechanism in the direction of valve opening.

8. The cooling control system for the engine according to claim 7, wherein said clutch mechanism receives an abnormal condition output from said control unit and turns a released state so that said flow control mechanism holds a valve opening state with said return spring.

9. A cooling control method for an engine, in which a circulating passage of a cooling medium is formed between a fluid conduit formed in the engine and a fluid conduit formed in a heat exchanger and heat generated in the engine is dissipated with the heat exchanger by circulating the cooling medium via a flow control mechanism in the circulating passage, comprising:

a step of fetching at least load information in respect of the engine and temperature information of the cooling medium;

a step of finding a target setting temperature of the cooling medium on the basis of the load information;

a step of finding a temperature deviation of the temperature information of the cooling medium from the target setting temperature;

a step of computing the temperature deviation and a changing velocity of a temperature deviation;

a step of generating a control signal for an actuator of the flow control means on basis of the relationship between the temperature deviation and the changing velocity of the temperature deviation; and a step of driving the actuator on the basis of the control signal and operating the flow control for the cooling medium flowing into the heat exchanger.

10. The cooling control method for the engine according to claim 9, wherein a step of determining whether or not the temperature deviation and the changing velocity of the temperature deviation are below predetermined values is further added in said step for generating the control signal to drive the actuator, and when the values of the temperature deviation and the changing velocity of the temperature deviation are determined to be below the predetermined values, a step of generating the control signal including an integral control element continuously and slightly changing the flow of the cooling medium, controlled by the flow control mechanism, at unit-times in response to the temperature deviations is performed, and when the values of the temperature deviation and the changing velocity of the temperature deviation are determined not to be below the predetermined values, a step of generating the control signal on the basis of flow setting data of the cooling medium which is read out from a map written to correspond with said temperature deviation and said changing velocity of the temperature deviation is performed.

* * * * *